US005563693A

United States Patent [19]

Takahata et al.

[11] Patent Number: 5,563,693

[45] Date of Patent: Oct. 8, 1996

[54] CONTACT TRANSFER DEVICE AND IMAGE FORMING EQUIPMENT

[75] Inventors: Toshiya Takahata; Tatsuro Ohsawa; Yasuhito Hirashima; Yoshiro Koga, all of Nagano, Japan

[73] Assignee: Seiko Epson Corporation, Tokyo, Japan

[21] Appl. No.: 322,427

[22] Filed: Oct. 13, 1994

[30] Foreign Application Priority Data

| | | | |
|---|---|---|---|
| Oct. 13, 1993 | [JP] | Japan | 5-256061 |
| Oct. 15, 1993 | [JP] | Japan | 5-258760 |
| Jul. 25, 1994 | [JP] | Japan | 6-172690 |

[51] Int. Cl.[6] ..... G03G 15/16

[52] U.S. Cl. ..... 355/274; 355/277; 430/109; 430/126

[58] Field of Search ..... 355/271, 273, 355/274, 275, 277, 219, 245; 430/109–111, 126

[56] References Cited

U.S. PATENT DOCUMENTS

| | | | |
|---|---|---|---|
| 5,223,900 | 6/1993 | Yuminamochi et al. | 355/273 |
| 5,307,122 | 4/1994 | Ohno et al. | 355/245 |
| 5,359,395 | 10/1994 | Shimura et al. | 355/219 |
| 5,422,214 | 6/1995 | Akiyama et al. | 430/111 X |

FOREIGN PATENT DOCUMENTS

| | | | |
|---|---|---|---|
| 0520819 | 12/1992 | European Pat. Off. . | |
| 0522812 | 1/1993 | European Pat. Off. . | |
| 3508379 | 9/1985 | Germany | G03G 15/22 |
| 2273576 | 6/1994 | United Kingdom . | |

OTHER PUBLICATIONS

Patent Abstracts of Japan, vol. 017 No. 268 (M–1416), 25 May 1993, & JP–A–05 004372 (Casio Comput Co Ltd) 14 Jan. 1993, *abstract.

Patent Abstracts of Japan, vol. 012 No. 029 (P–660), 28 Janvier 1988 & JP–A–62 180376 (Konishiroku Photo Ind. Co. Ltd.), 7 Aug. 1987, *abstract.

Patent Abstracts of Japan, vol. 016 No. 276 (P–1374), 19 Jun. 1992 & JP–A–04 070858 (Minolta Camera Co Ltd) 5 Mar. 1992, *abstract.

*Primary Examiner*—Robert Beatty

*Attorney, Agent, or Firm*—Sughrue, Mion, Zinn, Macpeak & Seas

[57] ABSTRACT

An image forming apparatus includes an image carrier, a transfer member contactable to the image carrier for transferring toner to a recording member and a bias source connected to the transfer member. The toner includes resin particles and external additives added thereto. The transfer member satisfies the following relationship, $R \geqq 0.350 + (0.001H)$ where R represents the aerated bulk density of the toner and H represents the hardness (JISA) of the transfer member. Also, the transfer member satisfies $4 \geqq W \geqq 16.0 - 3.52 \times R + 0.2 \times R^2$, where R represents the logarithmic value of the resistance of the transfer member and W (wt %) represents the amount of external additives added to the resin particles of the toner. In addition, where the resistance of the transfer member is expressed as R(Ω) and a current value of the transfer bias is expressed as It (μA), the following relationship is satisfied: $1.32 \times 10^{-4} L V_p \leqq It \leqq 2.66 \times 10^{-3} (\log(R) - 3.15) L V_p/d$ and $It \leqq 1.29 \times 10^{-2} L V_p/d$, where L (mm) is the longitudinal length of the contact surface between the transfer member and image carrier, $V_p$ (mm/s) represents the process speed and d (μm) represents the thickness of the photosensitive layer on the image carrier.

22 Claims, 14 Drawing Sheets

CONTACT TRANSFER DEVICE AND IMAGE FORMING EQUIPMENT

BACKGROUND OF THE INVENTION

1. Field of the Invention

The present invention relates to equipment for forming an image using an electrophotographic process and, in more particular, to image forming equipment suitable for constructing an electrophotographic process through the use of contact transfer.

2. Related Background Art

Recently, in image forming equipment using an electrophotographic process, instead of corona electrification and corona transfer that have been used conventionally, contact electrification and contact transfer have been studied in order to reduce the amount of ozone generation. As an example of the contact transfer, bias roller transfer has been examined. As a method for realizing the bias roller transfer, there have been studied (1) a constant voltage control method which applies a constant voltage to a transfer member, and (2) a constant current control method which applies a constant current to a transfer member.

However, in the constant voltage control method, since the resistance value of a recording member (such as paper) and a transfer member (such as a transfer roller) vary greatly according to the environment, good transfer has been difficult to attain using a constant voltage. For this reason, an improved constant voltage control method is proposed in U.S. Pat. No. 5,179,397. This proposed method (which is hereinafter referred to as an ATVC control method) detects the resistance value of a roller by applying a constant current to the roller and, in accordance with the detected resistance value, sets up a bias for transfer and then applies a constant voltage to the roller.

On the other hand, a constant current control method for realizing good transfer with respect to variations in the load of a transfer member and a recording member is disclosed in U.S. Pat. No. 3,781,105. However, in the constant current control method, when the width of the recording member varies, poor transfer results. Particularly, when the recording member becomes small, a current flows directly from the transfer member to the surface of an image carrier in an area where the recording member is not present to thereby lower an application voltage. In view of this, an improved method is disclosed in Japanese Patent Publication No. 2-272590 of Heisei which varies a current to be applied to a transfer means according to the width of a recording member.

Also, with respect to the bias roller transfer, the resistance value of the transfer member is also studied in various points along the member. For example, in *JAPAN HARD COPY* 1991 *FALL* "Roller transfer method using an elastic member of an intermediate resistance", a relatively high resistance value of the transfer member is used. This requires a high voltage supply source which is capable of outputting a voltage of the order of 4 kV or more, as a transfer supply source. In this case, if a portion of low resistance exists in part in a member of high resistance (which is hereinafter referred to as resistance value variation), or if the equipment is stopped during the paper clogging, then a high voltage of the order of 4 kV can be applied directly to a latent image carrier to open up a hole in a photosensitive layer on the latent image carrier. This in turn results in electrification and poor transfer (which is hereinafter referred to as a pin hole). The pin hole is found especially when an organic photosensitive member having a low dielectric strength is used as the latent image carrier. In order to prevent such a pin hole, there is also proposed a structure in which a high resistance layer is coated on the outer layer of the transfer member (transfer roller) to thereby produce a multi-layer roller. If a transfer member of low resistance is used, then a small bias is required for transfer even if the resistance value variation exists and thus use of the transfer member of low resistance is advantageous with respect to the pin hole. However, conventionally, it has been considered impossible to put this into practical use, because, if a transfer member of low resistance ($5\times10^8\Omega$ or less) is used, then the surface potential of the latent image carrier is turned into a reversed polarity due to the action of the transfer bias so that a ghost phenomenon will occur at the cycle of the latent image carrier. (This phenomenon is hereinafter referred to as an image memory, or, a ghost phenomenon.)

And, toner used in the contact transfer is also under study. For example, although not directly connected with the contact transfer, as not only an improvement in the deteriorated toner but also an improvement in a developing method, there is proposed a developing method which adds and mixes externally two kinds of fine powder having different mean particle diameters from each other, as can be seen in Japanese Patent Publication No. 2-45188 of Heisei.

However, the above-mentioned conventional techniques have the following problems to be solved.

First, in the ATVC control as disclosed in U.S. Pat. No. 5,179,397 or such variable current control as disclosed in Japanese Patent Publication No. 2-272590 of Heisei, means used to detect the resistance value of the transfer member, the width of the recording member and the like are necessary. Further, of course, a control system must be set up which uses such means. For this reason, these control methods are very disadvantageous in the cost and installation space of image forming equipment. Also, an expensive and complicated supply source is required in order to process the signal of the detect means by use of a microprocessor and to determine and change the output of a high voltage supply source.

Second, since the multi-layer roller used as the pin hole preventive means is a complex roller, rather than a single layer roller, it is overwhelmingly disadvantageous in the manufacturing method, manufacturing time, cost, and handling.

Thirdly, it has been found that when a toner composed of resin particles with two or more kinds of external additives having different particle diameters is used in a contact transfer device, poor transfer can occur. Examples of poor transfer are void or hollow character phenomenon (the phenomenon in which the central portion of a character is not transferred to the recording member, hereinafter referred to as a white void), density reduction contamination of the backside of the recording member due to fogging, and other unfavorable phenomena.

SUMMARY OF THE INVENTION

The present invention aims at eliminating the drawbacks found in the above-mentioned conventional methods. In other words, the present invention has a basic concept that various problems in the characteristics of the contact transfer are not solved by a complicated electronic control method represented by the ATVC control method and variable current control method. Instead, the problems are to be solved by studying more deeply and in more detail the component elements of a contact transfer device or the component elements of image forming equipment incorporating the contact transfer device.

Accordingly, it is a main object of the invention to provide a contact transfer device and image forming equipment incorporating the contact transfer device which uses a simple supply source free from complicated control, is low in cost, and is small in size.

It is another object of the invention to prevent the occurrence of a white void phenomenon for a long period of use regardless of variations in the environment.

It is still another object of the invention to stabilize a transfer efficiency for a long period of use regardless of variations in the environment to thereby prevent reduction in density.

It is yet another object of the invention to control the amount of fogging on a latent image carrier to thereby reduce the contamination of the back surface of a recording member such as paper.

It is a further object of the invention to realize good contact transfer of high quality using a simple constant current supply source regardless of the width of a recording member.

It is a still further object of the invention to control the occurrence of ghost phenomenon even when a transfer member is of a relatively low resistance.

It is a yet further object of the invention to provide a contact transfer device which is of high quality and highly reliable.

It is another object of the invention to prevent poor transfer due to the leakage of a transfer current.

The contact transfer device and image forming equipment incorporating the contact transfer device according to the invention are based on the above-mentioned basic concept. That is, in order to provide an expected contact transfer device and image forming equipment incorporating the contact transfer device, various members in connection with the operations thereof are carefully examined to thereby search for the conditions that can realize good contact transfer. After such careful examination, the present inventors have found that "toner", "external additives", "transfer member", "latent image carrier", "electrophotograph process speed", "transfer current", and "resistance values of various peripheral members in connection with the operation of contact transfer device" have a significant effect on the contact transfer characteristics.

In other words, the present invention is based on the following facts that have been discovered by the present inventors.

(1) If the resistance of the transfer member is set in the range of $10^6$ to $10^9\Omega$, then transfer is possible with a low transfer bias which does not exceed the yield strength of the latent image carrier. This is advantageous in the prevention of a pin hole, reduction in the cost of a power source and reduction in the size of the device. At the same time, this eliminates the need to provide a high resistance layer or the like on the outer layer of the transfer member. This is advantageous in reduction in the cost of the transfer member since the need for use of multi-layer roller is eliminated.

(2) If the relationship between the aerated bulk density of the toner and the hardness of the transfer member is optimized, then a white void phenomenon can be prevented to a great extent.

(3) If at least two kinds of external additives having different particle diameters are externally added to the toner particles and the amount of external addition thereof is optimized, then a transfer efficiency can be stabilized even through a durability test and an environmental test. Also, the density change can be reduced.

(4) In accordance with the kinds of the surface treating agents for surface treating the external additives to be added to the toner particles, the maximum values of the surface covering rates of the external additive vary. Therefore, if the maximum values are optimized for each of the surface treating agents, then the amount of fogging on the latent image carrier can be restricted to be within a given amount.

(5) If the amounts of the external additives and the resistance value of the transfer member are optimized, then good contact transfer can be realized by use of, a simple constant current supply source, regardless of the width of the recording member.

(6) If the resistance value of the transfer member, the width of the transfer member, the process speed, the thickness of the photosensitive layer of the latent image carrier, and the transfer current are optimized, then the ghost phenomenon can be prevented even when using a transfer member having a relatively low resistance.

(7) Since the relationship between the resistance values of members other than the transfer member which are to be in contact with the recording member and the process speed is optimized, poor transfer due to the current leakage can be prevented.

A contact transfer device and image forming equipment using the contact transfer device according to the invention will be described in detail by means of the following most suitable embodiments thereof.

DETAILED DESCRIPTION OF THE PREFERRED EMBODIMENTS

In the following description, in a first embodiment, a detailed description will be given mainly of "the resistance and hardness of a transfer member", "a toner", and "external additives", while in a second embodiment, a detailed description will be given mainly of "the resistance values of a transfer member and other members", "transfer current", "process speed", and "latent image carrier".

(Embodiment 1)

(1-1) Structure of Contact Transfer Device

Figure 1:
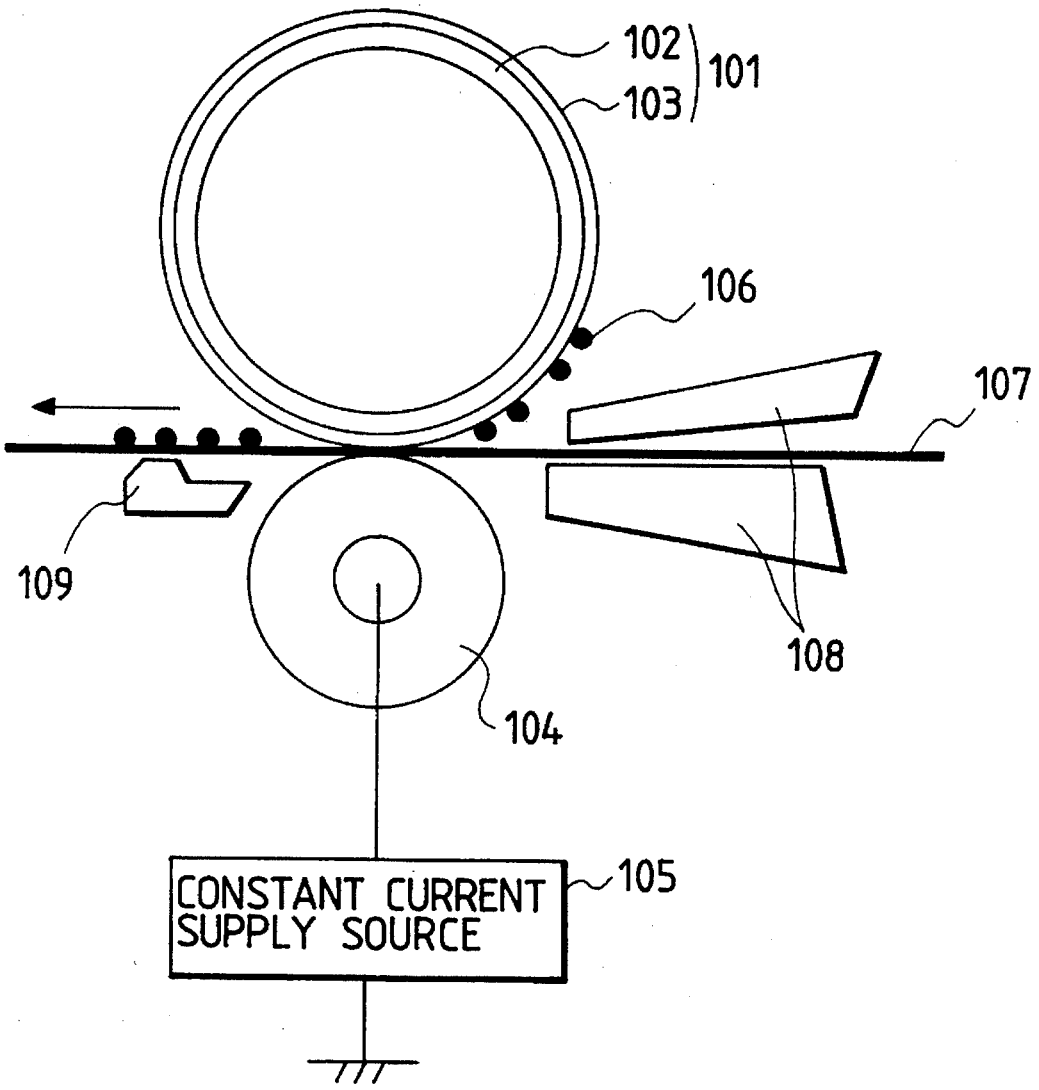
FIG. 1 is a general view of a first embodiment of a contact transfer device according to the invention.

FIG. 1 is a general view of a first embodiment of a contact transfer device according to the invention. In FIG. 1, a latent image carrier 101 includes a conductive support portion 102 and a photosensitive layer 103 formed of an organic material and having a light conductive property put on the conductive support portion 102. The latent image carrier 101 is structured such that it has a diameter of 30 mm and can be rotated at a peripheral speed of 24 mm/sec. (which is considered to be the process speed of 24 mm/sec.). The photosensitive layer 103 has a thickness of about 17 μm and a relative dielectric constant of about 3.2. On the other hand, a transfer roller 104 (having a diameter of 16 mm and a width of about 220 mm) is carried by an elastic member such as a spring, and is pressed against the latent image carrier 101 with a load of the order of several g –20 g/mm, so that there can be secured a nip of the order 1 to 4 mm between the transfer roller 104 and the latent image carrier 101.

And, simultaneously when the leading end of a recording member 107 reaches the transfer nip, a given current is supplied by a constant current supply source 105 and thus a toner 106 that is developed on the latent image carrier 101 is transferred onto the recording member 107. Here, paper is generally used as the recording member 107. However, besides paper, a post card, an envelope, a plastic film, a thin plate and the like can also be used.

The respective portions of a pre-transfer guide 108 and a post-transfer guide 109 and the like that are contactable with the recording member 107 are formed of a high-resistance material having a surface resistance of $10^9$ Ω or more in order to prevent current leakage in a high humidity environment. However, when the guides are formed of a high-resistance material, then an unfixed toner on the recording member 107 can be flown away due to frictional electrification between the recording member 107 and post-transfer guide 109 in a low humidity environment. Therefore, the post-transfer guide 109 is formed of such a material that does not electrify the recording member 107 excessively. In the present embodiment, polyethylene terephthalate with glass dispersed therein is used as the material of the post-transfer guide 109.

Although not shown, in the peripheral portions of the latent image carrier 101, there are disposed various members necessary for image formation, such as electrifying means, exposure means for forming an electrostatic latent image, developing means, cleaning means for cleaning the toner that is left after transfer, and the like.

(1-2) Constant Current Supply Source and its Operation

Figure 2A:
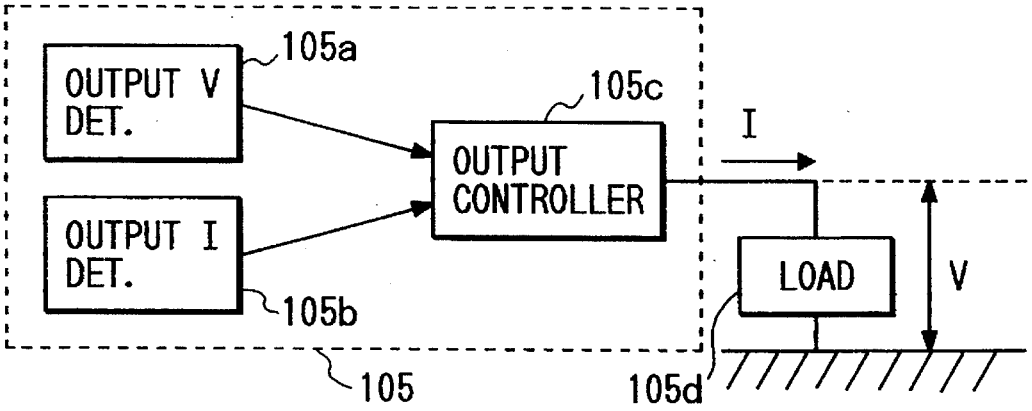
FIG. 2(*a*) is a block diagram of a constant current source employed in the first embodiment; and, FIG. 2(*b*) is a flow chart to explain the operation of the constant current source employed in the first embodiment.
Figure 2B:
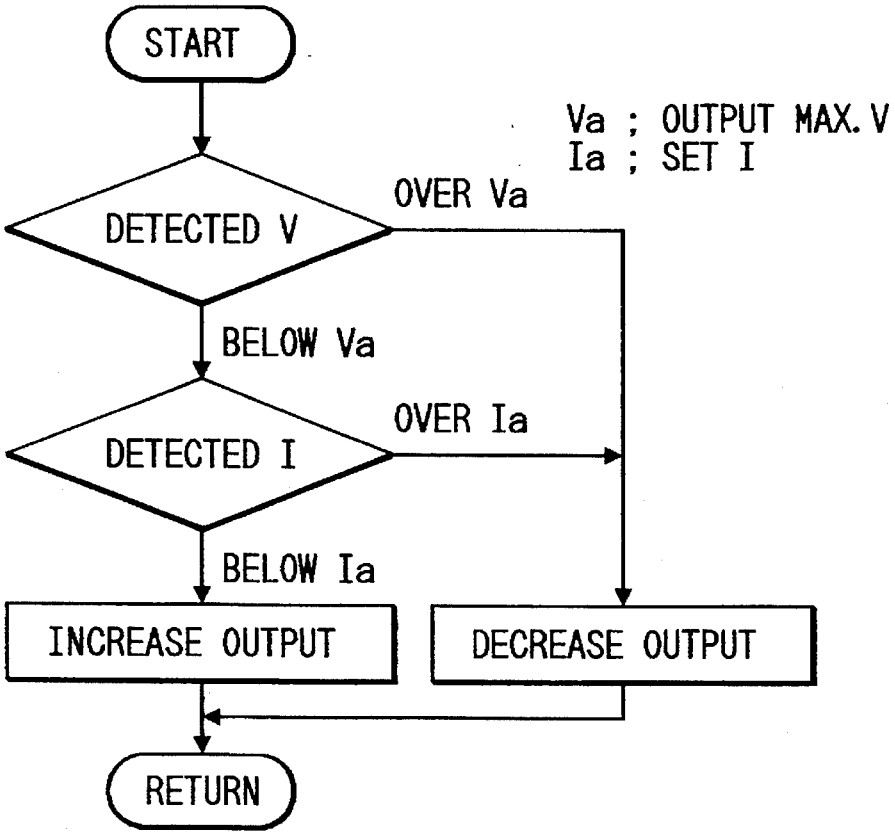

FIG. 2(*a*) is a block diagram of a constant current supply source 105. On receiving signals from output voltage detect means 105*a* and output current detect means 105*b*, output control means 105*c* controls and outputs a current in such a manner that the current is to be maintained constant, only when a load 105*d* exists.

FIG. 2(*b*) is a flow chart used to explain the operation of the constant current supply source 105. At first, it is checked whether a detected voltage V exceeds an output maximum voltage Va. If the former exceeds the latter, then the output maximum voltage Va is output. Therefore, in this case, the output is not a constant current output, but a current smaller than a set current Ia. If the detected voltage V does not exceed the output maximum voltage Va, then a detected current I is compared with the set current Ia and the output is raised or lowered such that the current provides a constant current Ia.

(1-3) Resistance Value of Transfer Roller (Transfer Member)

Next, a more detailed description will be given of a transfer roller 104. The transfer roller 104 is made of an elastic foam roller which is formed of a metal shaft with a conductive foam layer having a cell diameter of 50 to 150 μm. The transfer roller 104 is stably pressed against the latent image carrier 101 through the recording member 107 with a line pressure of several g –10 g/mm and is rotated substantially at the same peripheral speed as the latent image carrier 101. Further, the transfer roller 104 has various characteristics, such as, it is hard for a toner to adhere thereto, it does not contaminate the latent image carrier 101, it is hard to adhere, it is difficult to wear, it has a uniform surface so that it has good contact with the latent image carrier 101, etc. The hardness of the roller is measured by a JISA hardness meter at three points in the axial direction and at four points in the peripheral direction, that is, the average value of the data measured at 12 points is used.

Figure 3:
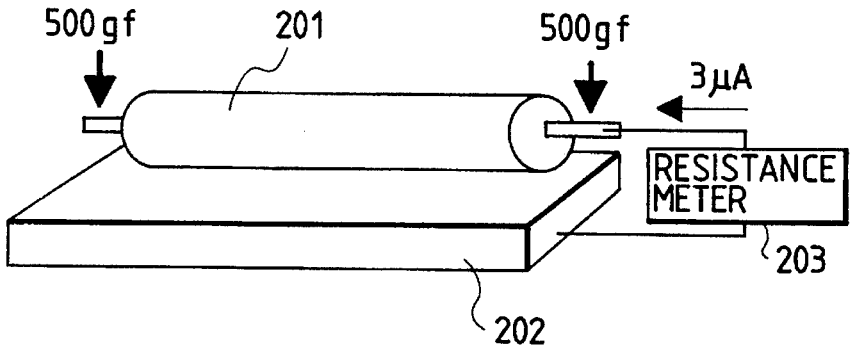
FIG. 3 is an explanatory view of a method of measuring the resistance of a transfer roller.

The resistance value of the transfer roller 104, an important physical property, is measured according to a method shown in FIG. 3. A roller 201, with loads each of 500 gf applied to the two shaft ends thereof, is pressed against a conductive plate 202. A resistance meter 203 is connected between the shaft of the roller 201 and the conductive plate 202 so as to measure the resistance of the roller 201. An applied current in the resistance measurement is 3 μA and a resistance value of the transfer roller is obtained in 20 seconds later.

In the invention, the transfer roller 104 can have a resistance value range of $10^6$ to $10^9\Omega$. A roller having a resistance value of less than $10^6\Omega$ is not preferable. That is, in this case, when a high duty pattern such as an all black pattern is printed, toner becomes attached to the transfer roller 104 containing no recording member therein and a latent image carrier which are in direct contact. The attached toner can contaminate the backside of the paper in the next image forming operation. Otherwise a ghost phenomenon may occur. On the other hand, if the resistance value greatly exceeds $10^9\Omega$, then in a low humidity environment in which the recording member 107 can easily have a high resistance value, the output maximum voltage of the constant current supply source 105 must be set for a very high value that exceeds 4 kV. This unfavorably leads to the increased size and cost of the device as well as to the occurrence of a pin hole in the photosensitive layer 103.

Table 1 shows the evaluation results of the ghost phenomenon and transfer roller contamination when a constant current supply source of 3 μA is used, and the evaluation results of the output bias necessary for transfer under a dry environment. For reference, as regards the ghost phenomenon, a more detailed description will be given in embodiment 2 to be discussed later.

TABLE 1

| Transfer roller resistance (logarithmic value) | Evaluation on ghost phenomenon and transfer roller contamination | Transfer output bias evaluation |
|---|---|---|
| 5.1 | x | ○ |
| 6.0 | Δ | ○ |
| 7.2 | ○ | ○ |
| 8.1 | ○ | ○ |
| 9.2 | ○ | Δ |
| 9.9 | ○ | x |

(Standards for evaluation on ghost phenomenon and transfer roller contamination)
○: Transfer roller of this resistance value is free from ghost phenomenon and transfer roller contamination and can be put into practical use sufficiently.
Δ: Transfer roller of this resistance value may cause a ghost phenomenon to occur according to print duty but can be put into practical use.
x: Transfer roller of this resistance value causes transfer roller contamination and a ghost phenomenon to occur and cannot be put into practical use.
(Transfer output bias evaluation standards)
○: Transferrable under 2000 V.
Δ: Transferrable in the range of 2000 to 4000 V.
x: Bias voltage of 4000 V or more is required.

Figure 4:
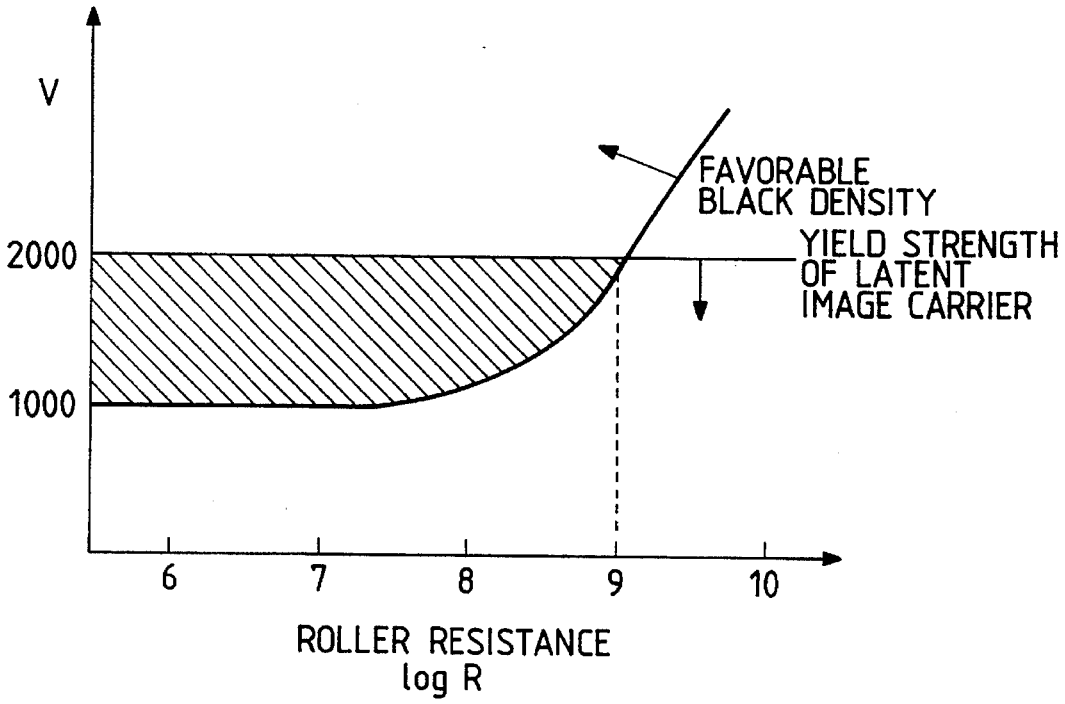
FIG. 4 is a graphical representation of the resistance of a transfer roller, a bias voltage necessary for transfer, and the yield strength of a latent image carrier.

FIG. 4 shows a transfer voltage required when the entire all-black pattern is transferred to a recording member 107 including a paper with water content of 2% and a width of 216 mm (which is hereinafter referred to as a letter size) in a dry environment, with the transfer roller resistance as a parameter.

In a dry environment the recording member 107 and transfer roller 104 are caused to have a high resistance value and, when the contact transfer device is structured using a constant current supply source, a high voltage is output. Therefore, the dry environment is unfavorable because a pin hole can easily occur. The higher the transfer roller resistance, the higher the voltage required. In particular, when the transfer roller resistance exceeds $10^9$ Ω, then a voltage exceeding the 2 kV yield strength of the latent image carrier 101 is necessary in order to satisfy the black density. (Note that while the value of the yield strength varies according to the kind and thickness of a photosensitive layer, in the present embodiment, since a photosensitive layer having a yield strength of 120 V/μm is used, the yield strength is of the order of 2 kV.) Therefore, when a portion of a low roller resistance or a portion of the photosensitive layer 103 having a small thickness exists where the portions of the latent image carrier 101 and transfer roller 104 are in direct contact with each other, a voltage equal to or greater than the yield strength applied to the latent image carrier 101 results in a pin hole in the photosensitive layer. In view of this, FIG. 4 shows a good transfer area represented by oblique lines. If the roller resistance is $10^9$ Ω or less, then transfer is possible at a voltage equal to or less than the yield strength of the latent image carrier. Thus, pin holes are prevented even if the resistance of the transfer member varies a little. The result is easier manufacturing and lower cost, as compared to the conventional contact transfer device, since the need to create a multilayer by providing a high resistance layer in the periphery of the transfer member is eliminated.

(1-4) Toner Aerated Bulk Density & External Additives and Transfer Roller Hardness Next, a description will be given of the toner 106 to be used in the present invention. The toner 106 can be a magnetic or non-magnetic toner having a volume average particle diameter of 5 to 20 μm which is manufactured according to an ordinary manufacturing method such as a blending and grinding method, a spray dry method, or a polymerizing method. If the particle diameter of the toner 106 exceeds 20 μm, then the resolving power of the image is lowered. On the other hand, if the particle diameter of the toner 106 is 5 μm or less, then the probability of the toner 106, which is left after transfer, slipping through the cleaning means is unfavorably increased. Preferably, the particle diameter of the toner should be in the range of 7 to 14 μm.

The concrete toner compositions are as follow:

| | |
|---|---|
| Polyester resin | 88 wt % |
| Polypropylene wax | 5 wt % |
| Charge control agent | 1 wt % |
| Carbon black | 6 wt % |

The above-mentioned compositions are blended and ground roughly by a screw extruding machine. Then, they are ground finely by a jet grinder, and are then classified to produce toner particles having a volume average particle diameter of 9 μm.

Next, using a Henschel mixer, external additives having different average particle diameters (13 nm and 40 nm, a particle diameter ratio of 3.08) are each mixed into the surfaces of the toner particles in a given amount (0 to 1.5 wt %) to thereby produce a toner. A method of treating the surfaces of the external additives will be described below.

"Surface treatment A": The external additives each having a large particle diameter (40 nm) and a small particle diameter (13 nm) were both surface treated with dimethyl silicone oil. The hydrophobic rate of the external additives was 60% or more.

"Surface treatment B": The external additives each having a large particle diameter and a small particle diameter were both surface treated with hexamethyl disilazan. The hydrophobic rate of the external additives was 50 to 60%. The physical properties of the toner produced according to the surface treatment B were equivalent to those of the toner produced according to the surface treatment A, except that the toner produced according to the surface treatment B had good fluidity (aerated bulk density).

"Surface treatment C": The external additive having a large particle diameter was surface treated with dimethyl silicone oil, while the external additive having a small particle diameter was surface treated with hexamethyl disilazan. The physical properties of the toner produced according to the surface treatment C were equivalent to those of the toner produced according to the surface treatment A, except that the toner produced according to surface treatment C had good fluidity.

For reference, the measurement of the toner aerated bulk density was made by using a powder tester manufactured by Hosokawa Micron.

Table 2 shows the evaluation results of the levels of the white void phenomena obtained when a transfer test was conducted on an OHP film using a contact transfer device according to the invention. In Table 2, there are also shown the aerated bulk densities of the respective toners. The OHP film is considered to easily cause a white void phenomenon, among various recording members. The toners used were respectively produced according to the surface treatments A, B, and C. With regard to the amounts of the external additives, the amount of the large particle diameter external additive was fixed to 0.5 wt %, while the amount of the small particle diameter external additive was varied in the range of 0 to 0.5 wt %. A transfer roller having a hardness of JISA 20 deg. was used. The evaluation standards follow. The levels that are equal to or higher than the level (3) are considered to be allowable levels.

TABLE 2

| Toner Amounts of external additives having small particle diameters | None | 0.1 wt % | 0.3 WT % | 0.5 WT % |
|---|---|---|---|---|
| Surface treatment A toner Aerated bulk density (g/cc) | Level (1) 0.354 | Level (2) 0.363 | Level (3) 0.373 | Level (4) 0.381 |
| Surface treatment B toner Aerated bulk density (b/cc) | Level (2) 0.365 | Level (3) 0.370 | Level (4) 0.382 | Level (5) 0.393 |
| Surface treatment C toner Aerated bulk density (g/cc) | Level (1) 0.355 | Level (2) 0.366 | Level (4) 0.380 | Level (5) 0.393 |

Level (5): No white void phenomenon is found at all.
Level (4): White void phenomenon occurs slightly but it cannot be recognized at all during use of OHP film.
Level (3): White void phenomenon occurs slightly and can be recognized slightly during use of OHP film. However, it doesn't matter in practical use.
Level (2): White void phenomenon occurs and raises a problem in use of OHP film.
Level (1): White void phenomenon can occur even in use of other recording members other than OHP film.

From the above results, it is found that, even if the amounts of the external additives are the same, the levels of the white void phenomena vary according to the methods of treating the surfaces of the external additives. It is also found that there exists an interrelation between the aerated bulk density (which is used as a parameter) and the white void phenomenon level. When the transfer roller having a hardness of 20 deg. is used in the above evaluation, every one of the toners produced according to the three kinds of surface treatment provides an allowable level when the aerated bulk density thereof exceeds approximately 0.37 (g/cc). Also, if the external additives which are surface treated with hexamethyl disilazan are used (in the present embodiment, these are the external additives which have received the surface treatments B and C), then a large aerated bulk density can be secured with a small amount of external additives. This is especially effective as a white void phenomenon countermeasure because the better the fluidity (that is, the larger the aerated bulk density), the smaller the adhering force between the toners as well as between the toner and latent image carrier.

Figure 5:
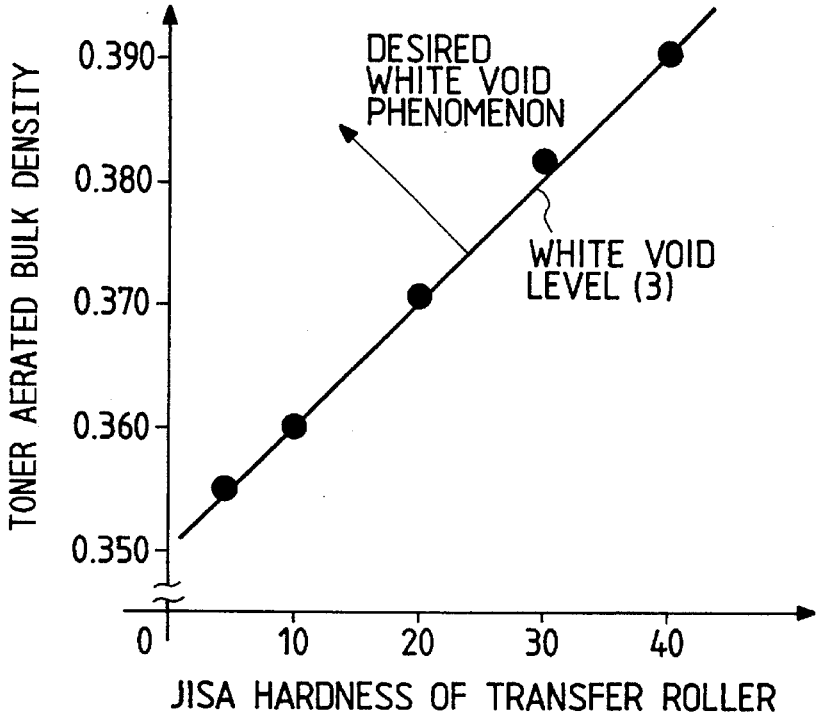
FIG. 5 is a graphical representation of a relationship between the aerated bulk density of a toner, the hardness of a transfer roller, and satisfactory areas for a white void phenomenon.

FIG. 5 shows the results of the level (3) (practically usable area) points found after a similar white void phenomenon evaluation is executed using the aerated bulk density and roller hardness (JISA) as a parameter. When the toner aerated bulk density is expressed as R (g/cc) and transfer roller hardness (JISA) is expressed as H, then it is found that the toner aerated bulk density and transfer roller hardness must be set according to the following relationship:

$$R \geqq 0.350+0.001 \times H.$$

A factor for deteriorating the OHP film to cause the white void phenomenon is that the harder the roller, the higher the surface pressure.

(1-5) Amounts of Addition of External Additives Differing in Particle Diameters

Figure 6:
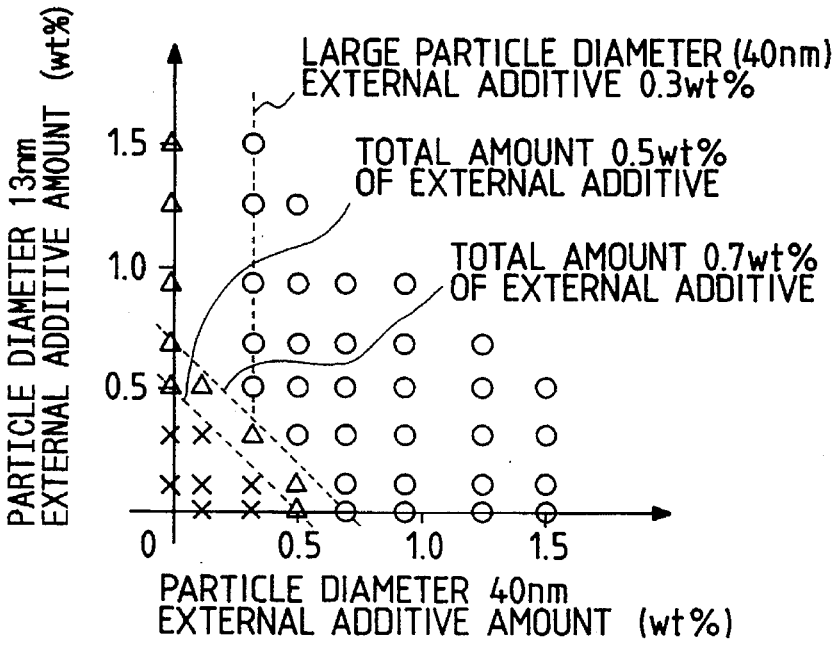
FIG. 6 is a graphical representation of the results of image evaluation after a 10,000-transfer durability test, using the amount of an external additive having a large particle diameter and the amount of an external additive having a small particle diameter as parameters.

FIG. 6 shows the results of the evaluation of the differences in the toner optical densities between the initial state of the toner and the state of the toner after a 10,000 sheets durability test was conducted by the contact transfer device shown in FIG. 1. The surface treatment A toner was used in all combinations of the large particle external additives with the small particle. The evaluation standards are as follows:

○: Optical density difference is 0.15 or less. Toner can be sufficiently put into practical use.

Δ: Optical density difference is 0.15 to 0.3. Toner can be put into practical use.

x: Optical density difference is 0.3 or more. Toner cannot be put into practical use.

The test conditions are as follows:

Transfer roller: resistance $10^8\Omega$, hardness JISA 20 deg.

Transfer supply source: 2 μA constant current supply source (output max. voltage 2,000 V)

As can be seen clearly from FIG. 6, if a total of the large particle diameter (40 nm) external additive and the small particle diameter (13 nm) external additive is 0.5 wt % or more, then there exists a practically usable area. More preferably, a total amount may be 0.7 wt % or more and the amount of the large particle diameter external additive may be 0.3 wt % or more. The surface treatment B toner and the surface treatment C toner were evaluated similarly and the evaluation results were found to be equivalent to those of the surface treatment A toner. The greater the amounts of external additives, especially, the greater the amount of addition of the large particle diameter external additive, the smaller the differences in the density variations through the durability test. It seems that this tendency is caused by the fact that the external additives are difficult to be embedded into the resin particles.

Figure 7:
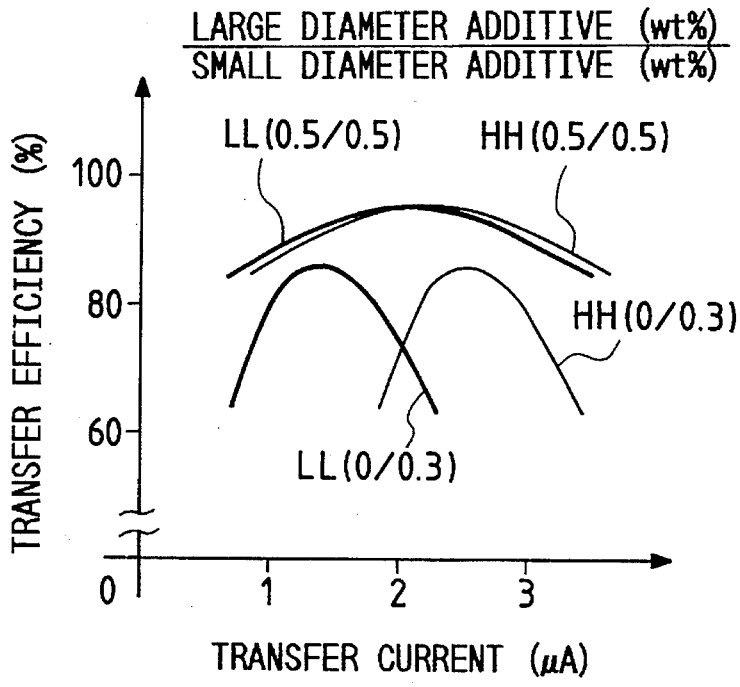
FIG. 7 is a graphical representation of transfer efficiencies in the 10° C. 15%RH environment (which is hereinafter referred to as an LL environment) and the 35° C. 65%RH environment (which is hereinafter referred to as an HH environment) after a 10,000-transfer durability test.

FIG. 7 shows transfer efficiencies respectively under the LL and HH environments obtained after 10,000 sheets durability test conducted on a toner with only the small particle diameter external additive of 0.3 wt %, and a toner with the external additives of a total of 1.0 wt % including the large particle diameter external additive of 0.5 wt % and the small particle diameter external additive of 0.5 wt %. The transfer efficiency was calculated according to the following equation:

Transfer efficiency={(Amount of toner on latent image carrier before transfer)−(Amount of toner left on latent image carrier after transfer)}÷(Amount of toner on latent image carrier before transfer)×100 (%) (Equation 1)

From FIG. 7, it is found that the toner with only the small particle diameter external additive of 0.3 wt % is difficult to transfer using the constant current supply source because the peak values of the transfer efficiencies thereof after the 10,000 sheets durability test vary according to the environment. Thus, in order to improve the transfer efficiency for effective contact transfer, the transfer current must be varied according to the environment. Also, when the toners after the durability test were respectively observed by means of 10,000 times SEM (electron microscope) photographs, it was observed that, in the case of the toner with only the small particle diameter external additives of 0.3 wt %, the external additives are all embedded and thus the surface of the toner is exposed. Meanwhile, in the case of the toner with the large particle diameter external additives of 0.5 wt %, the state of attachment of the external additives to the toner varies little from the initial state. From FIG. 7 and the observation results of the SEM photographs of the toners after the durability tests it is found that the toner with the external additives embedded therein has a greatly lowered transfer efficiency and also, because the current values at which the transfer efficiencies reach their peaks vary according to the environment, transfer by use of the constant current supply source is difficult. The reason why the embedded external additives in the toner lower the transfer efficiency of the toner seems to be that the embedded external additives increase the mechanical attachment between the latent image carrier 101 and the toner to thereby make it difficult for the toner to be transferred to the recording member 107.

It is undesirable for a total amount of the large particle diameter (40 nm) and small particle diameter (13 nm) external additives to exceed 4 wt %. The reason is that the external additives easily cohere together and floating external additives increase, which can give rise to bad influences such as fogging, contamination of the device and the like.

(1-6) Surface Covering Ratio of External Additives

Figure 8:
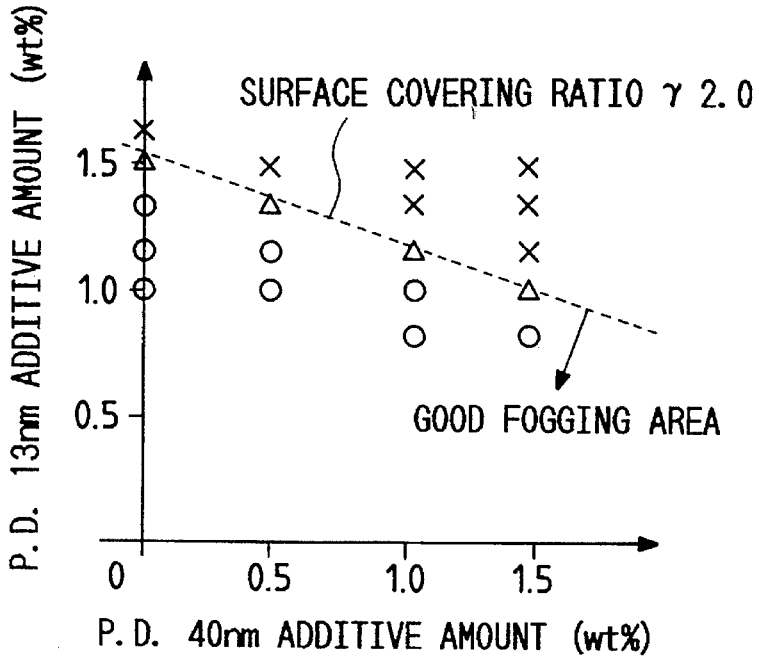
FIG. 8 is a graphical representation of a relationship between the amount of fogging on the latent image carrier of a surface treatment A toner and the amounts of external additives respectively having large and small particle diameters.

FIG. 8 shows the results of evaluation on the relationship between the amount of fogging on the latent image carrier 101 and the amount of external addition of the large and small particle diameter external additives by use of the surface treatment A toner. Since the fogging gives rise to the contamination of the backside of the paper, it is necessary to control the fogging to a given value or less. The evaluation standards are as follows:

○: Amount of fogging on latent image carrier is 0.03 $mg/cm^2$ or less. Toner can be put into practical use sufficiently.

Δ: Amount of fogging on latent image carrier is 0.03 to 0.04 $mg/cm^2$ Toner can be put into practical use.

x: Amount of fogging on latent image carrier is 0.04 $mg/cm^2$ or more. Toner cannot be put into practical use.

Figure 9:
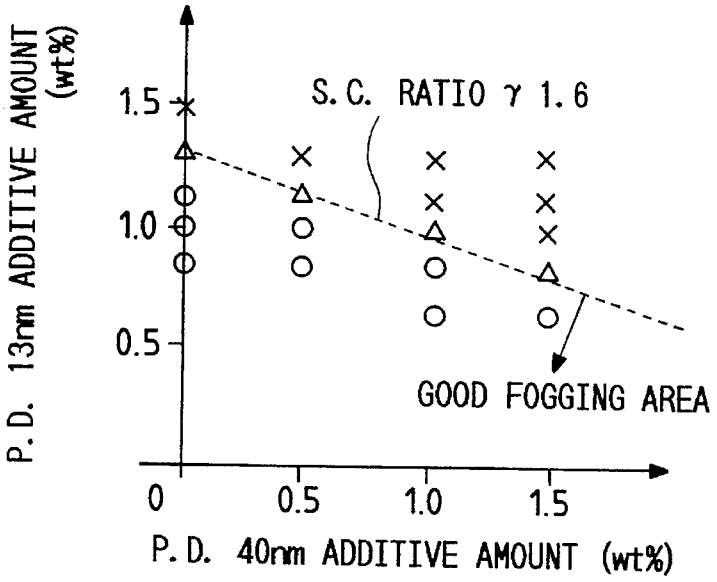
FIG. 9 is a graphical representation of a relationship between the amount of fogging on the latent image carrier of a surface treatment B toner and the amounts of external additives respectively having large and small particle diameters.

As can be seen from FIG. 8, as the total amount of the external additives increases, the fogging worsens. Therefore, the present inventors paid attention to a surface covering ratio (γ) and discovered a line on which the surface covering ratio γ is 2.0. As a result, it is determined that there exists a close relationship between a practically usable area and the surface covering ratio. FIG. 9 shows the fogging and the surface covering ratio in the case of the surface treatment B toner. When compared with the surface treatment A toner, a good fogging area is narrow. Thus, good fogging was obtained when the surface covering ratio γ is 1.6 or less.

FIGS. 8 and 9 show that there exists an interrelation between the surface covering ratio (γ) and the fogging, and that a good fogging area varies according to the materials used in surface treatment. In the surface treatment A toner, a good fogging area exists in the surface covering ratio of 2.0γ or less. In the surface treatment B toner, a good fogging area exists in the surface covering ratio of 1.6γ or less. In the surface treatment C toner, a good fogging area exists in the surface covering ratio of 1.8γ or less. The reason why the good fogging area varies according to the materials used in surface treatment is not clear. However, it can be imagined that the electrifying property of the toner varies according to the hydrophobic rates of the external additives. The surface covering ratio (γ) was calculated according to the following equation on the assumption that the external additives and toner particles are globular in shape and are not in cohesion:

$$\text{Surface covering ratio } (\gamma)=\Sigma(1/\pi\cdot R/ri\cdot\rho/\rho i.Wi/100) \quad \text{(Equation 2)}$$

where, R is the radius (m) of toner particles, ri is the radius of external additives, ρ is the density ($kg/m^3$) of toner particles, ρi is the density ($kg/m^3$) of external additives, and Wi is the amount (wt %) of addition of external additives i to toner particles.

(1-7) Amount of External Additives and Transfer Roller Resistance

Conventionally, it has been difficult to realize good contact transfer using a constant current supply source regardless of the width of a recording member and of the environment. However, according to the invention to be described below, the need for a means to change a transfer current according to the width of the recording member and according to the environment is eliminated. A detailed description of the results of our experiments are given below.

Figure 10:
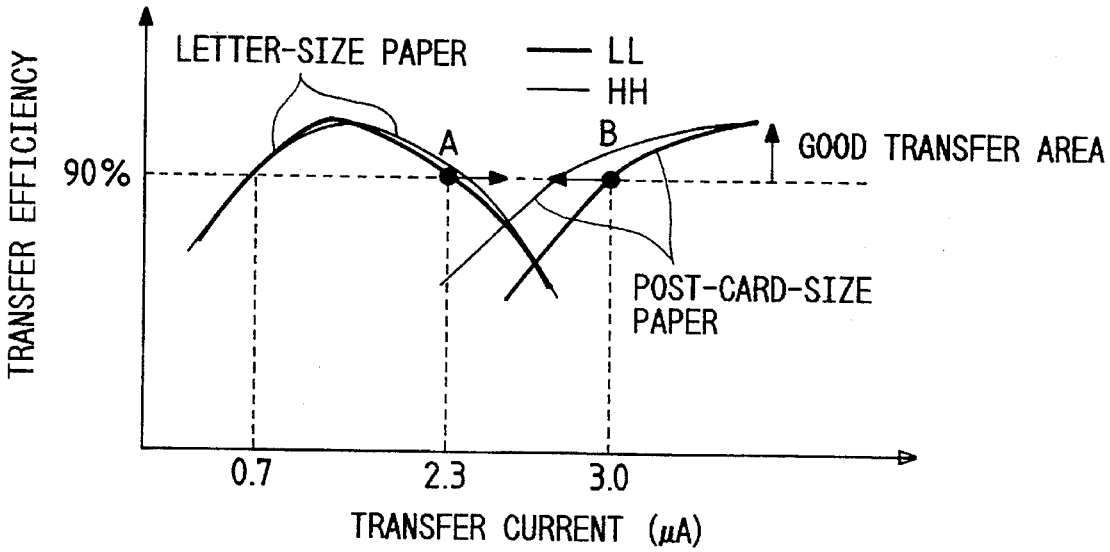
FIG. 10 is a graphical representation of the transfer efficiencies of letter- and post-card-size paper in the LL and HH environments.

FIG. 10 shows in graphical representation of the transfer efficiencies of letter-size paper having a width of 216 mm and a post-card-size paper having a width of 100 mm which are both used as recording members under the LL and HH environments. In FIG. 10, an area in which a transfer efficiency exceeds 90% is referred to as a good transfer area. For the experiment, a transfer roller 104 of $10^8\Omega$, and a toner 106 formed of 0.4 wt % of resin particles with external additives such as silica or the like were used.

FIG. 10 shows that since the good area of the transfer efficiency varies according to the widths of the recording members, transfer at a constant current is impossible. Especially, under the LL environment, the good transfer area varies greatly according to the widths of the recording members.

Figure 11:
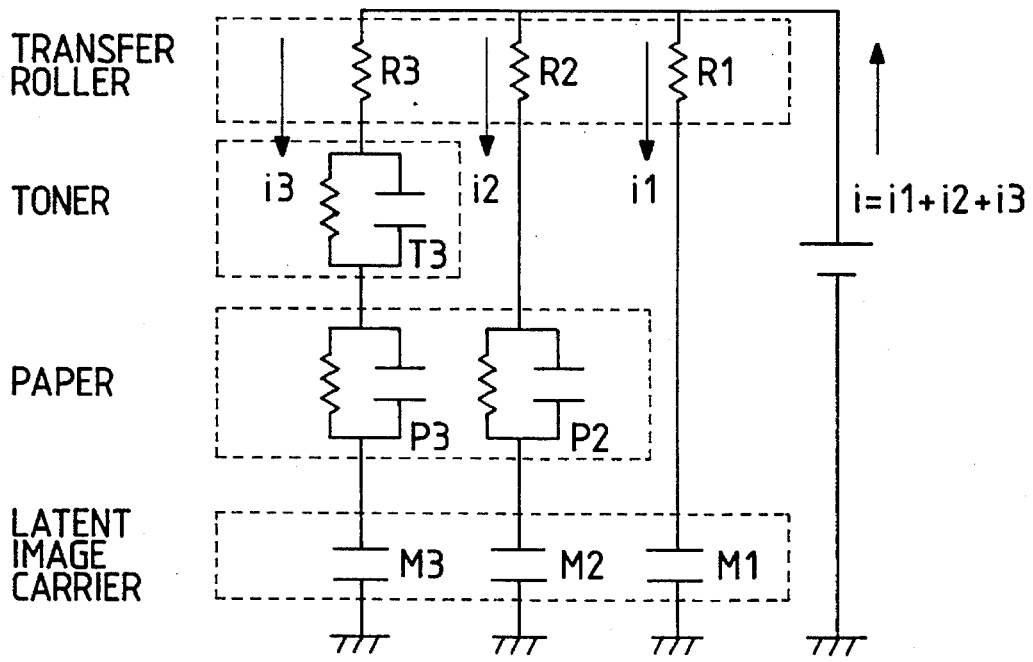
FIG. 11 is a circuit diagram of a bias roller transfer which is modeled into an equivalent circuit.

FIG. 11, which is a circuit diagram of an equivalent circuit used for roller transfer, will be used to help describe why the good transfer area varies according to the widths of the recording members under the LL environment. Since the recording member has a high resistance value under the LL environment, a current i1 flows more easily to a portion of low impedance with which a transfer roller R1 containing no recording member therein and a latent image carrier M1 are in direct contact. As a result, only the small current i3 flows in toner layer T3 so that a sufficient bias voltage cannot be applied to the toner layer T3. Therefore, in order to apply a transfer executable bias voltage to the toner layer T3 when a recording member having a narrow width is used under the LL environment, an increased amount of current i is required. That is, the equivalent circuit model of the bias roller transfer shown in FIG. 11 shows the reason why the good transfer area varies according to the widths of the recording members, especially under the LL environment. Also, the reason why a constant current is allowed to flow in spite of the fact that there is a capacitor included in the equivalent circuit shown in FIG. 11 is that a new toner layer, a new recording member layer, and the photosensitive layer of a new latent image carrier are always charged by the rotational movements of the latent image carrier and transfer roller.

Now, from FIG. 10, it can be estimated that, if the current at a point A, where the transfer efficiency of the letter-size paper falls, increases, or if the current at a point B, where the transfer efficiency of the post-card-size paper rises, decreases, then a good transfer area can be secured at a constant current regardless of the widths of the recording members. The present invention is based on the following two facts that have been discovered by the present inventors.

1. If the amount of the external additives to be added to the toner is increased, then the current of point A increases.

2. If the resistance of the transfer roller is increased, then the current at point B decreases. This will be described below in detail.

Figure 12:
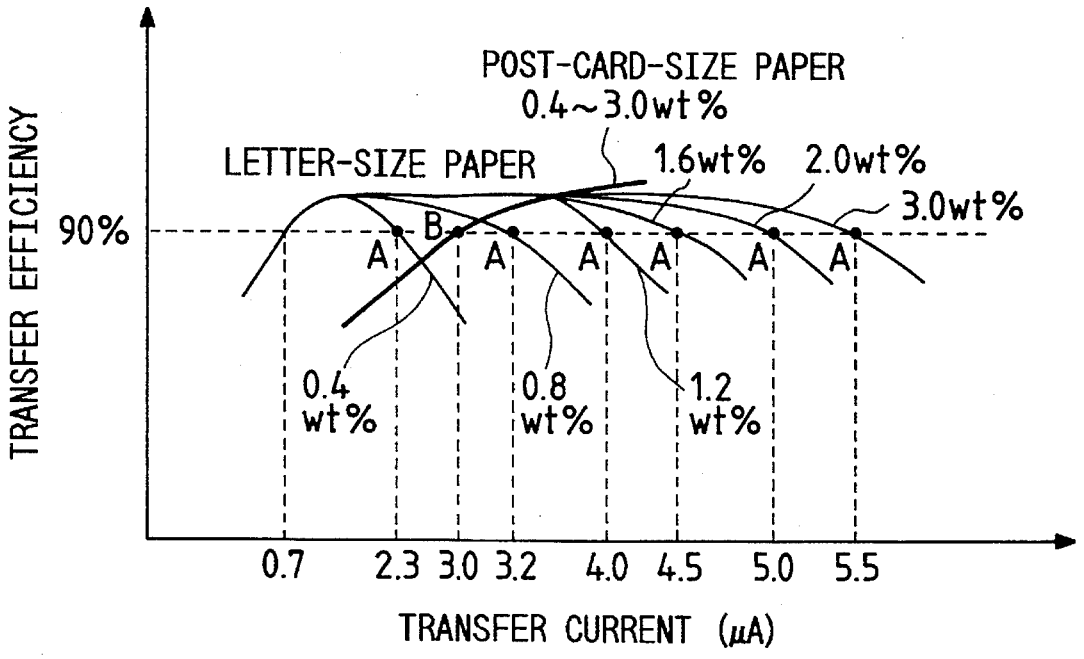
FIG. 12 is a graphical representation of transfer efficiencies when letter-size paper and postcard-size paper are transferred in the LL environment, with the amount of addition of external additives used as a parameter.

FIG. 12 shows transfer efficiencies obtained when images are transferred to the letter-size paper and post-card-size paper under the LL environment. For the experiment, a transfer roller of $10^8\Omega$, and a toner 106 which is formed of resin particles with 0.4 to 3.0 wt % of external additives such as silica or the like were used. The experiment showed that the current at a point A, where the transfer efficiency of the letter-size paper falls, increases according to the amounts of the external additives. Meanwhile, the current at point B, where the transfer efficiency of the letter-size paper rises and the transfer efficiency of the post-card-size paper rises, remains almost constant regardless of the amounts of the external additives. The reason why the value of the current at the point A increases as the amounts of the external additives increase is not clear. However, generally, it is said that the reason why the transfer efficiency falls is that the toner layer cannot be biased sufficiently due to electric discharge phenomena occurring between minute gaps in the toner. Therefore, it seems that the reason why the current value at the point A increased is that the probability of the minute gaps existing in the toner decreased, thereby making it difficult for the discharge phenomena to occur.

Figure 13:
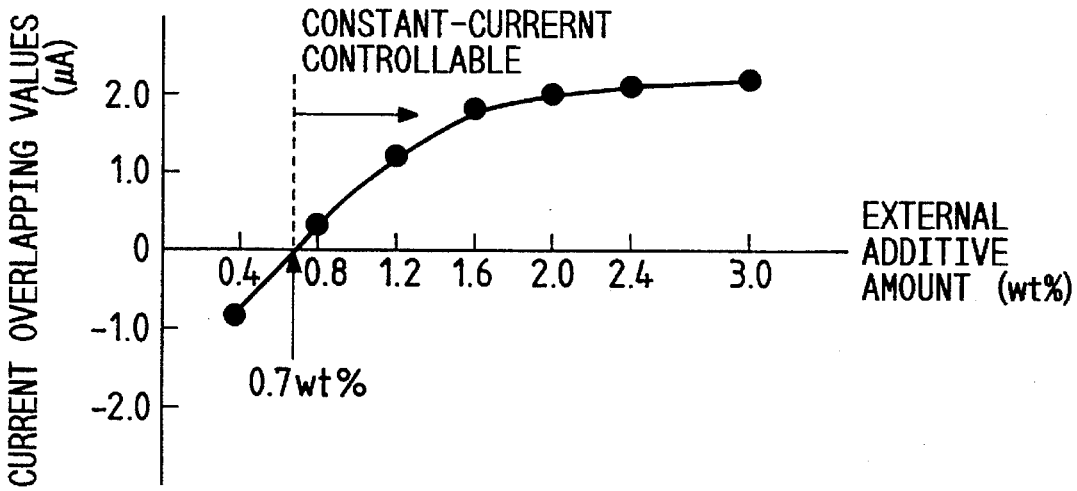
FIG. 13 is a graphical representation of a relationship between the amount of addition of external additives in a toner and current overlapping values.

In FIG. 13, there is shown a relationship between current overlapping values and the amount of external additives. The current overlapping values are obtained by subtracting the current values at the point B from the current values at the point A. In FIG. 13, an area, in which the current overlapping values are positive values, is equivalent to a constant current controllable area. At this roller resistance, constant current control is possible by using external additives of 0.7 wt % or more.

Figure 14:
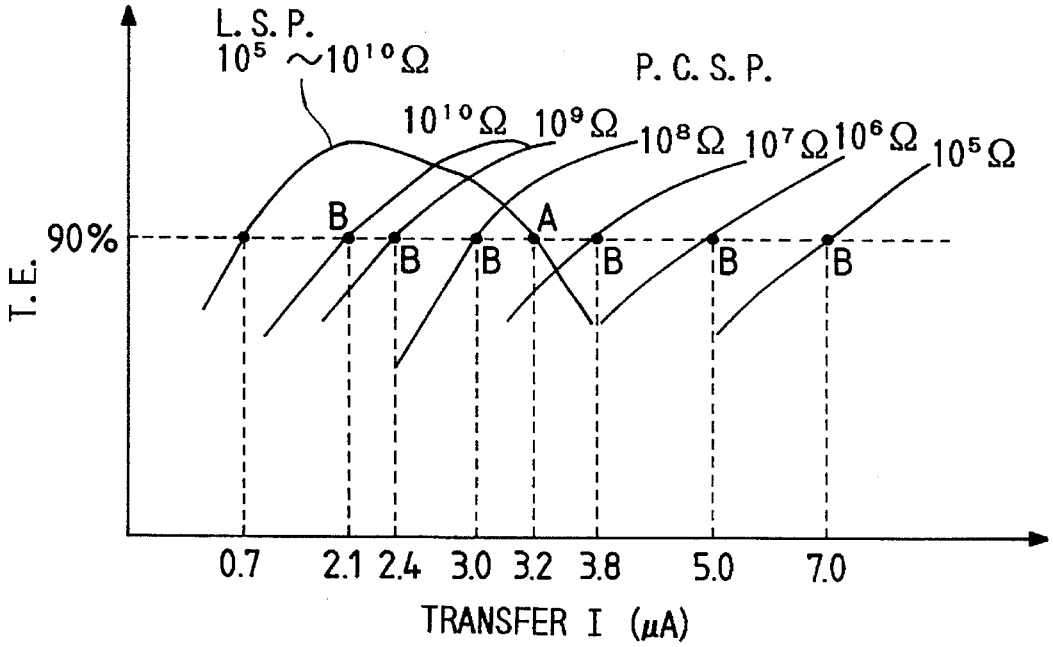
FIG. 14 is a graphical representation of transfer efficiencies when letter-size paper and post-card-size paper are transferred in the LL environment, with the resistance of a transfer roller used as a parameter.

Now, FIG. 14 shows transfer efficiencies obtained when images were transferred to the letter-size paper and post-card-size paper under the LL environment. For the experiment, a transfer roller of $10^5$ to $10^{10}\Omega$, and a toner 106 formed of resin particles with 0.8 wt % of external additives such as silica or the like added externally thereto were employed. The current at point A, where the transfer efficiency of the letter-size paper falls, remains almost constant regardless of the roller resistance, whereas the current at point B, where the transfer efficiency of the post-card-size paper rises, decreases as the roller resistance increases. This operation will be described using FIG. 11. When the roller resistance is low, the impedance of a portion (R1+M1), in which the latent image carrier 101 and transfer roller 104 are in contact with each other, becomes very low when compared with a portion (R2+P2+M2) in which a recording member P2 exists together with these two elements and a portion (R3+T3+P3+M3) in which a toner T3 and a recording member P3 exist together with the two elements. Therefore, for constant current control, a current, for the most part, flows to i1, which requires a large amount of current i in order to bias the toner layer sufficiently. When the roller resistance increases, then the impedance of the portion (R1+M1) approaches the impedance of a portion in which the toner exists and thus the current is easy to flow to i3, so that transfer is possible with a small current i. Accordingly, the higher the roller resistance, the lower the current at point B.

Figure 15:
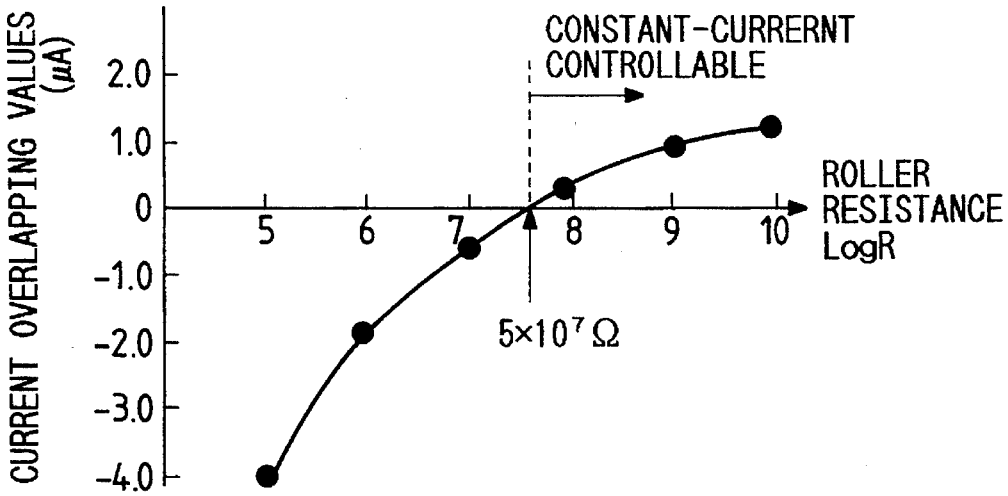
FIG. 15 is a graphical representation of a relationship between the resistance of a transfer roller and current overlapping values.

In FIG. 15, there is shown a relationship between current overlapping values and roller resistance. The current overlapping values are obtained by subtracting current values at the point B from current values at the point A. In FIG. 15, an area in which the current overlapping values are positive is equivalent to a constant current controllable area. In the case of 0.8 wt % of the external additives, constant current control is possible by using a roller resistance of $5\times10^7\Omega$ or more.

Figure 16:
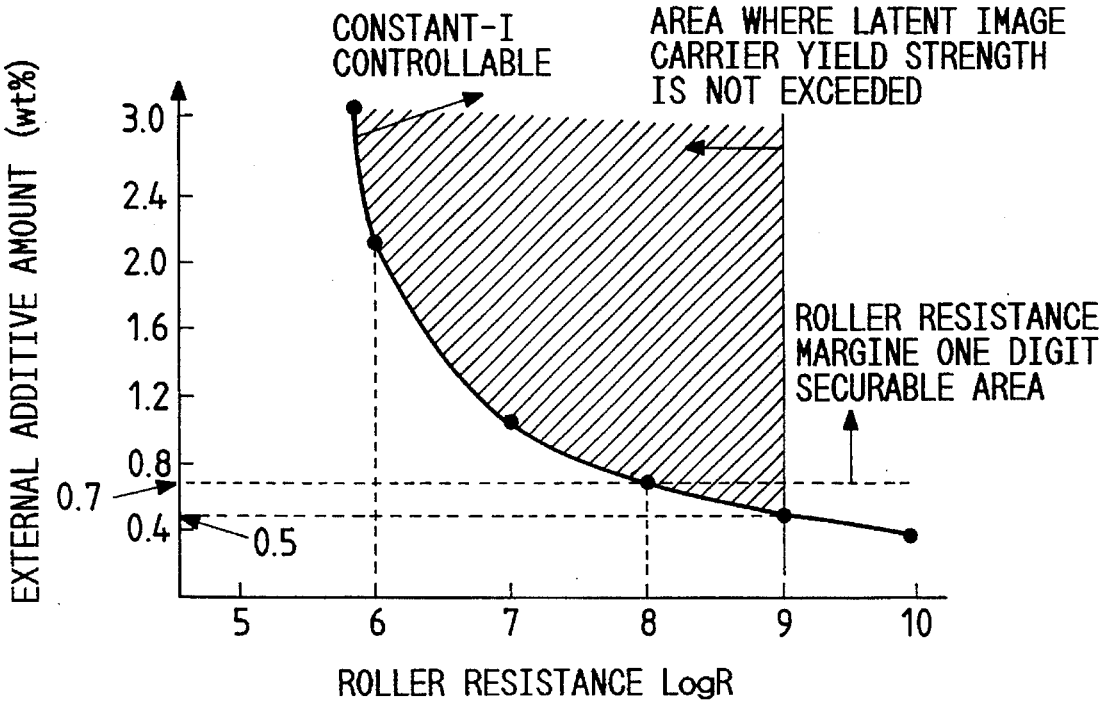
FIG. 16 is a graphical representation of the areas that can be controlled by a constant current with the resistance of a transfer roller and the amount of addition of external additives as parameters.

FIG. 16 shows a constant current controllable area (an area in which the current overlapping values are 0or more) and a range not exceeding the yield strength of the latent image carrier previously shown. Also shown are the amounts of the external additives contained in the toner 106 and the resistance values of the transfer roller 104, which are obtained by synthesizing the results of FIGS. 13 and 15.

From FIG. 16, it is found that, if the amount of the external additives is 0.5 wt % or more and the resistance value of the transfer member 104 is $10^9\Omega$ or less, then transfer is possible in the range not exceeding the yield strength of the latent image carrier 101 and constant current control is possible by means of a constant current regardless of the widths of the recording member 107. The lower limit value of the roller resistance, as can be seen clearly from FIG. 16, depends on the constant current controllable area and varies according to the amount of the external additives contained in the toner to be used. Also, when the transfer roller is produced at low costs, there exists a variation in the resistance value of the transfer roller due to the manufacturing lot or electric energization of the order of one digit. In view of this, FIG. 16 shows an area in which the roller resistance can secure one digit or more variation. It is found that, to satisfy these three characteristics (that is, a constant current controllable area, an area not exceeding the yield strength of the latent image carrier, and a roller resistance margin one digit securable area) simultaneously, the amount of the external additives must be 0.7 wt % or more. That is, the more preferable range of the amount of the external additives is 0.7 wt % or more. Since as the amount of the external additives increases, the roller resistance margin widens, it is preferable that the amount of the external additives is as large as possible. However, even if 2.0 wt % or more external additives are added, the roller resistance margin widens little. The reason for this seems that an increase in the amount of the external additives allows the good transfer area to widen (that is, the point A in FIG. 10 moves right) but this also lowers the roller resistance (that is, the point B in FIG. 10 moves right). The latter (ill) effect is greater than the former (good) effect. This shows that the lower limit value of the roller resistance is $10^6\Omega$. Also, in FIG. 16, if the constant current controllable area is expressed by means of the amount of the external additives W (wt %) and the logarithmic value R of the roller resistance, then the following equation is obtained:

$$W \geqq 16.0-3.52\times R+0.2\times R^2 \quad \text{(Equation 3)}$$

If the contact transfer device is structured such that the roller resistance and the amount of the external additives in the toner can satisfy the equation (3), then images of high quality can be obtained by means of a constant current supply source regardless of the widths of a recording member and regardless of the environment.

However, in the present embodiment as well, it is not preferable for the amount of the external additives W (wt %) to be larger than 4%. Therefore, the upper limit value of W in the equation 3 is 4.

(Embodiment 2)

Conventionally, it has been said that a transfer roller of $5\times10^8\Omega$ or less causes a ghost phenomenon and thus it cannot be used. However, it is now found that such transfer roller can be used if a transfer current is optimized. A detailed description of an embodiment relating to a ghost phenomenon and the set value of a transfer current will be given below. Also, description will be given of the leakage of the transfer current as well.

(2-1) Whole Structure of Image Forming Equipment

Figure 17:
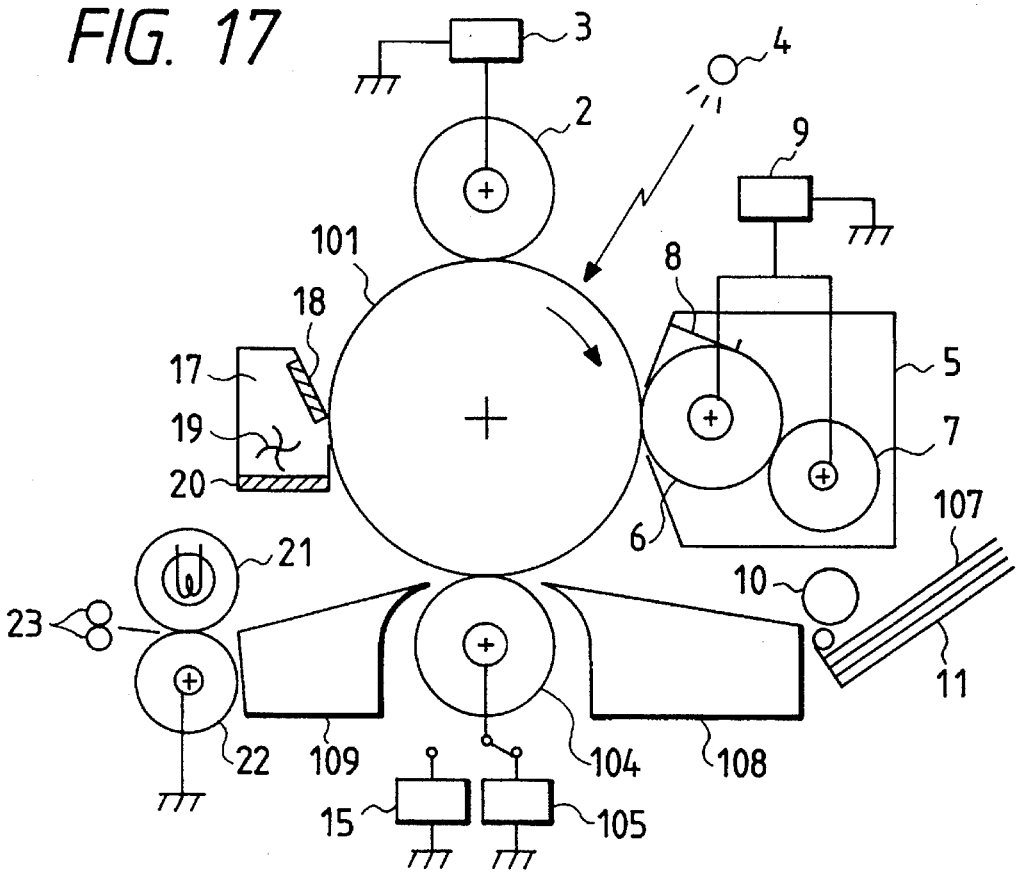
FIG. 17 is a general side view of a second embodiment of a contact transfer device and image forming equipment incorporating the contact transfer device according to the invention.

At first, description will be given below of image forming equipment used in the invention using FIG. 17. FIG. 17 is a schematic side view of the main portions of a second embodiment of image forming equipment used in the invention. The second embodiment is similar in basic structure to the first embodiment shown in FIG. 1.

In the central portion of the equipment, there is disposed a latent image carrier 101 around which there are arranged an electrifying roller 2, exposure means 4 using a semiconductor laser, a developing device 5, a transfer roller 104 which is a contact transfer member, and a cleaning device 17.

The latent image carrier 101 is a two-layer organic photosensitive member which is formed of a conductive substrate and a photosensitive layer formed on the conductive substrate, the latter having a film thickness of 17 μm and a specific electric conductivity of 3.2. Additionally, the latent image carrier 101 is rotationally driven in a direction of the arrow in FIG. 17 at the process speed of 24 mm/s. The electrifying roller 2 is connected to a constant voltage supply source 3 and, in the electrifying operation, is given a voltage of −1150 V by the supply source 3 to electrify the latent image carrier 101 to a voltage in the range of −500 to −700 V. The electrifying roller 2 has a diameter of 16 mm and a resistance value of $10^6$ to $10^8\Omega$, is formed of a metal core having a diameter of 6 mm, and includes urethane solid rubber disposed on the outer periphery of the metal core. Electrostatic latent images are formed on the latent image carrier 101, which is electrified to a given potential, in accordance with an image signal by the exposure means 4 using a semiconductor laser or the like. A negatively electrified toner is developed on the latent images formed on the latent image carrier 101 by the developing device 5. The developing device 5 includes a developing roller 6 having a diameter of 16 mm for developing the toner onto the latent image carrier 101, a supply roller 7 having a diameter of 13 mm for supplying the toner onto the developing roller 6, and a control blade 8 formed of stainless steel for controlling the amount of the toner to be delivered onto the developing roller 6 and for negatively electrifying the toner. The toner is formed of resin particles containing, as a coloring agent, carbon dispersed therein and a given amount of external additives such as silica or the like externally added onto the surfaces of the resin particles. In developing, a voltage of −270 V is applied to the developing roller 6 and the metal core of the supply roller 7 by the supply source 9 and thus the negatively electrified toner delivered to the developing roller 6 is developed. A recording member 107 which consists mainly of paper set by a paper feed cassette 11, is guided through an ante-transfer guide 108 and is delivered to a transfer position by a pickup roller 10.

Synchronously when the recording member 107 arrives at the transfer position, a given transfer current is applied to the transfer roller 104 from a constant current supply source 105 for a given period of time, and the toner images formed on the latent image carrier 101 are transferred onto the recording member 107. When the recording member 107 is not located between the latent image carrier 101 and the transfer roller 104, a cleaning bias voltage of −900 V is applied from the constant voltage supply source 15. In the transfer roller 104 which has a diameter of 16 mm, urethane foam rubber having a cell diameter of 50 to 150 μm is formed in the outer periphery of the metal core having a diameter of 6 mm. The foam rubber available to be used in the transfer roller are available silicone foam rubber, EPDM foam rubber, NBR foam rubber, styrene system foam rubber, polyethylene foam rubber and the like. The transfer roller 104 used in the present embodiment has a hardness of approximately 15° (JIS A) and a resistance value of $10^4$ to $10^9$. In transfer if a given current is applied, then a transfer voltage of the order of 1 to 3 kV is generated under the LL environment, while a transfer voltage of the order of 200 to 1200 V is generated under the HH environment. The transfer roller 104 has a length of 220 mm in the longitudinal direction, is pressed against the latent image carrier 101 with a total load of 1 to 2 kg so that a transfer nip of 1 to 4 mm can be formed, and can be driven by the latent image carrier 101 by means of a gear approximately at the same speed of the latent image carrier 101.

The recording member 107 that has passed through the transfer nip is then delivered along a post-transfer guide 109 to a fixing device. The toner images formed on the recording member 107 are fixed by a heat roller 21, which is heated up to a temperature of the order of 150° C., and by a backup roller 22 and then, are discharged from the device by a paper discharge roller 23. The heat roller 21 has a resistance of $10^6\Omega$ and includes a bearing which is insulated and thus is electrically floated. The backup roller 22 has a resistance of $10^{13}\Omega$ and includes a metal core which is grounded. The distance between the transfer nip and a fixing nip formed by the backup roller 22 and heat roller 21 is 50 mm.

The transfer residual toner left on the latent image carrier 101 is collected by the cleaning device 17. More specifically, the toner on the latent image carrier 101 is scraped down by a cleaning blade 18 and is then collected by a screw 19 into a discharge toner box 20. Although in the following description of the second embodiment the latent image carrier 101 is described as an organic photosensitive member, this is not limitative. Other members can be used such as an inorganic photosensitive member, a dielectric member composed of a conductive material and a dielectric material attached to the conductive material, and the like.

(2-2) Resistance and Width of Transfer Roller, Transfer Current, Process Speed, and Latent Image Carrier Conventionally, it has been said that the ghost phenomenon occurs at a transfer current of 3 μA or more. More specifically, it has been said that, in order to prevent a ghost phenomenon from occurring, in a paper non-inserted state where a latent image carrier and a contact transfer member are in direct contact with each other, a current having a value equal to or larger than a given value which can positively electrify a photosensitive material must not be allowed to flow. Also, the prior art has not been able to use effectively a contact transfer member having a low resistance. On the other hand, the present inventors have found a relationship between a print duty and a transfer current which causes a ghost phenomenon, and have established a transfer condition which can prevent the ghost phenomenon from occurring even when the contact transfer member has a low resistance. (Here, the print duty means a ratio of an area to be occupied by an image portion in a transfer nip.) A detailed description of the relationship between the print duty and the transfer current which causes a ghost phenomenon will be given below.

Figure 18:
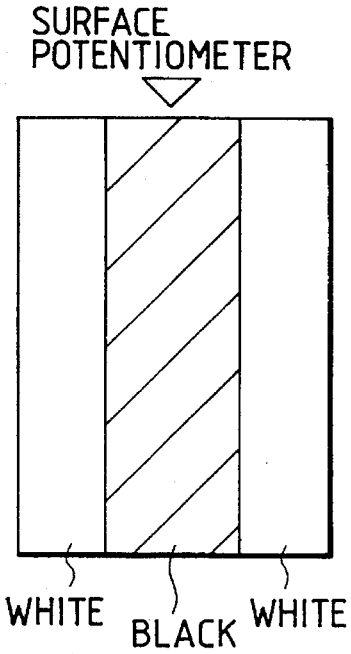
FIG. 18 is a view of an image pattern used to measure the surface potential of a black portion after electrification.
Figure 19:
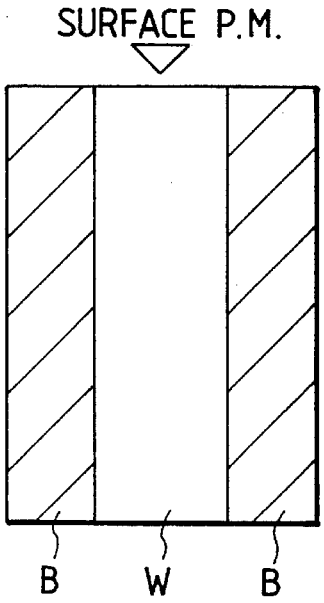
FIG. 19 is a view of an image pattern used to measure the surface potential of a white portion after electrification.

As described above, the present inventors studied the print duty. That is, using such image patterns as shown in FIGS. 18 and 19, the inventors varied the print duty in the range of 0 to 100% to print images, and measured the surface potential of the latent image carrier after being electrified next time (which is hereinafter referred to as a post-electrification surface potential) with respect to each of a transferred image portion (which is hereinafter referred to as a black portion) and a non-image portion (which is hereinafter referred to as a white portion). In measuring the postelectrification surface potential, a surface electrometer (manufactured by Trek Co.) was used. The surface electrometer is situated substantially centrally with respect to the longitudinal direction of the latent image carrier between the electrifying roller 2 and exposing device 4 in FIG. 17. The transfer current is allowed to vary in the range of 0 to 5 μA.

The above measurement was made in the LL and HH environments using ordinary copying paper (having a paper water content of approximately 2.5% under the LL environment and a paper water content of the order of 9% under the HH environment, and a longitudinal length of 216 mm) as a recording member. Also, the electrified potential of the latent image carrier wad in the range of −580 to −600 V in the LL environment and in the range of −600 to −620 V in the HH environment.

Figure 20:
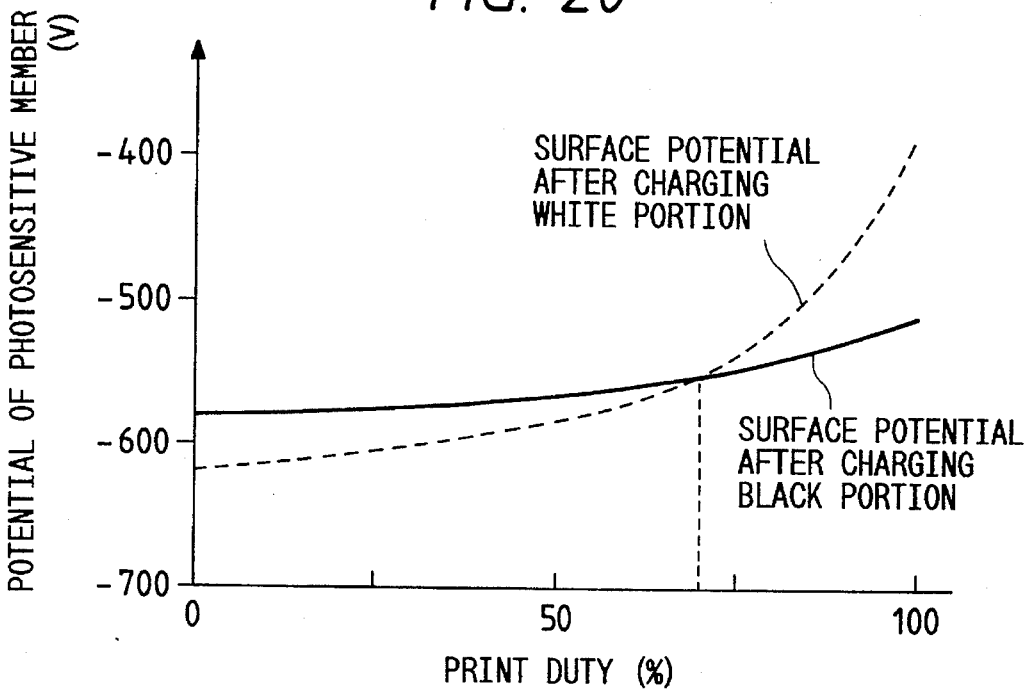
FIG. 20 is a graphical representation of a relationship between the print duty and the surface potential of a latent image carrier after electrification for a transfer current of 3 μA in the LL environment.

FIG. 20 shows a relationship between the black portion and white portion post-electrification surface potentials and the print duty when transfer is executed at a transfer current of 3 μA in the LL environment. It can be seen from FIG. 20 that the post-electrification surface potential of the black portion does not vary so much with the print duty, whereas the white portion post-electrification surface potential varies greatly with the print duty. And, FIG. 20 also shows that the white portion post-electrification surface potential begins to be lower than the post-electrification surface potential of the black portion when the print duty exceeds approximately 70%, and that the former lowers as the print duty increases. This is because the impedance of the black portion is greater than the impedance of the white portion, which makes it hard for a current to flow into the black portion. Thus, most of the transfer current (total current) flows intensively into the white portion. Also, the smaller the white portion is (that is, the higher the print duty is), the more intensively the current flows into the white portion. Due to this, even if the transfer current (total current) is small, the amount per unit area of the current that flows in the white portion is almost equal to the amount per unit area of the transfer current (total current) that causes a ghost phenomenon in the paper non-inserted state, so that a local ghost phenomenon can occur.

Figure 21:
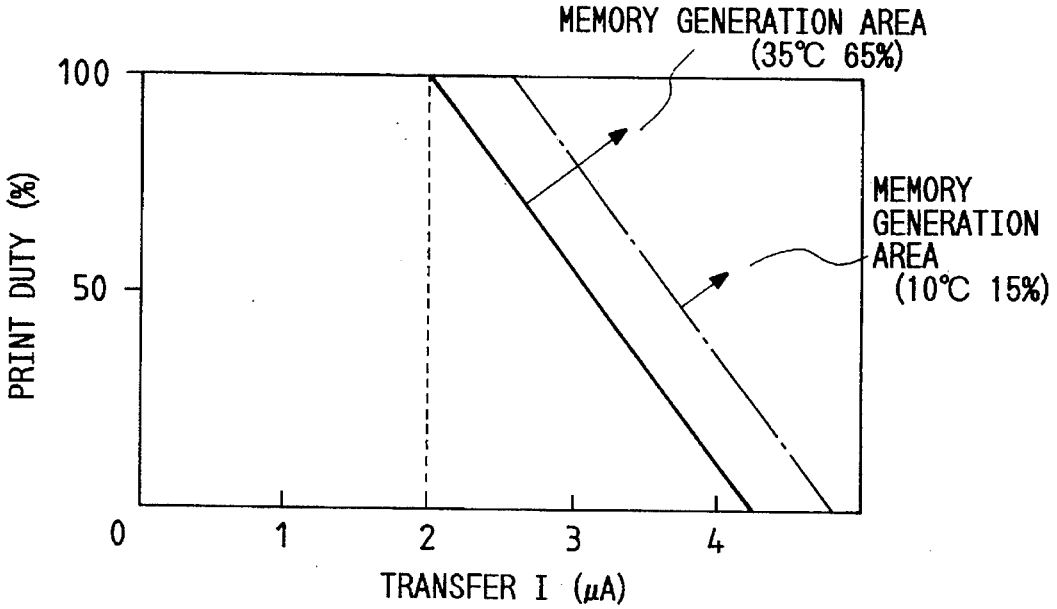
FIG. 21 is a graphical representation of a relationship between the print duty and the transfer current that causes a ghost phenomenon in the LL and HH environments.

Now, in FIG. 21, there is shown a relationship between the print duty and the transfer current that causes a ghost phenomenon, which are obtained from the above experiment conducted in the LL and HH environments. A transfer roller having a resistance of $4\times10^5\Omega$ was used. In the HH environment, an absorbent recording member such as paper turns into a low resistance recording member to thereby increase the difference in impedance between the white and black portions, which makes it easy for the ghost phenomenon to occur. From FIG. 21, it is found that if $It \leqq 2.0$ μA, where It is a transfer current (μA), the ghost phenomenon is prevented from occurring regardless of the print duty in all environments. In FIG. 21, the amount of the external additives of the toner was 0.8 wt %. However, the ghost phenomenon does not correspond to the amount of the external additives of the toner.

Figure 22:
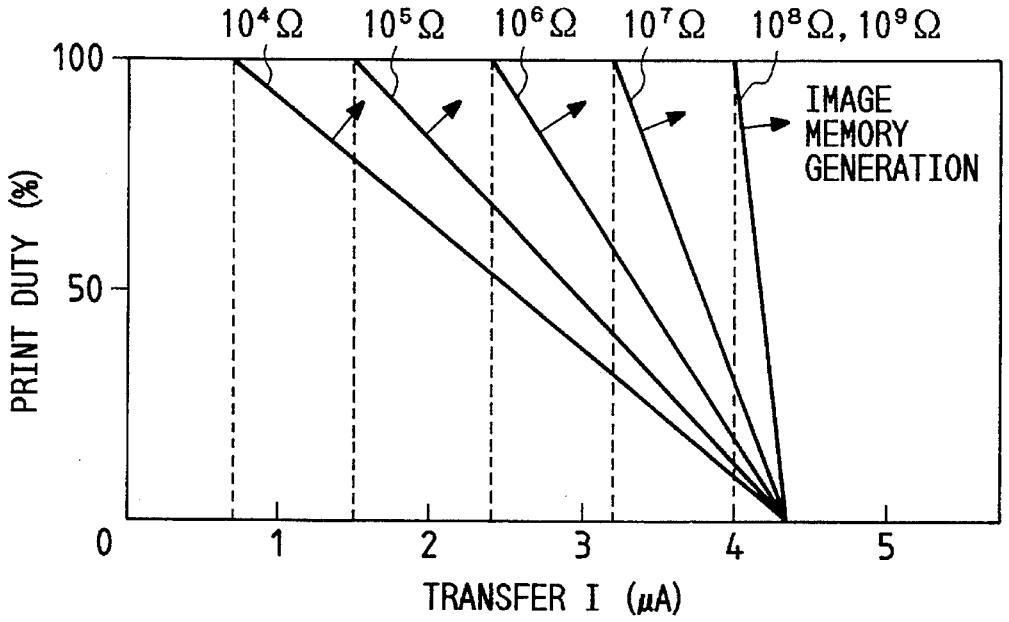
FIG. 22 is a graphical representation of a relationship between the transfer roller resistance, print duty and the transfer current that causes a ghost phenomenon in the HH environment.

FIG. 22 shows a relationship between the transfer roller resistance and the transfer current that prevents occurrence of the ghost phenomenon in the HH environment. This experiment was conducted similarly to the above experiment, while varying the transfer roller resistance in the range of $10^4$ to $10^9\Omega$. From FIG. 22, it is found that, if the transfer roller resistance is increased, then the current values that satisfy the condition of non-occurrence of the ghost phenomenon approach the current value (4.2 μA) when the print duty is 0%.

When the transfer roller resistance is $10^8\Omega$ or more, a current value of 4 μA or less is effective in preventing the occurrence of the ghost phenomenon and, in this range, the effective current value varies little according to the transfer roller resistance. This is because, if the transfer roller resistance is increased, then the difference in impedance between the black and white portions decreases. Therefore, a conventionally used high resistance roller, the resistance value of which exceeds $10^9\Omega$, is almost independent of the print duty and thus can be used with no problem, provided that it satisfies the condition that does not cause a ghost phenomenon when the print duty is 0% (or, in a paper non-inserted state). On the other hand, since the contact recording member used in the present invention is of a low resistance value, the conventional knowledge as to the ghost phenomenon occurrence condition is insufficient for the present contact recording member. That is, to satisfy the condition that prevents the occurrence of the ghost phenomenon, it is necessary for the current value range to be defined by the present invention.

Figure 23:
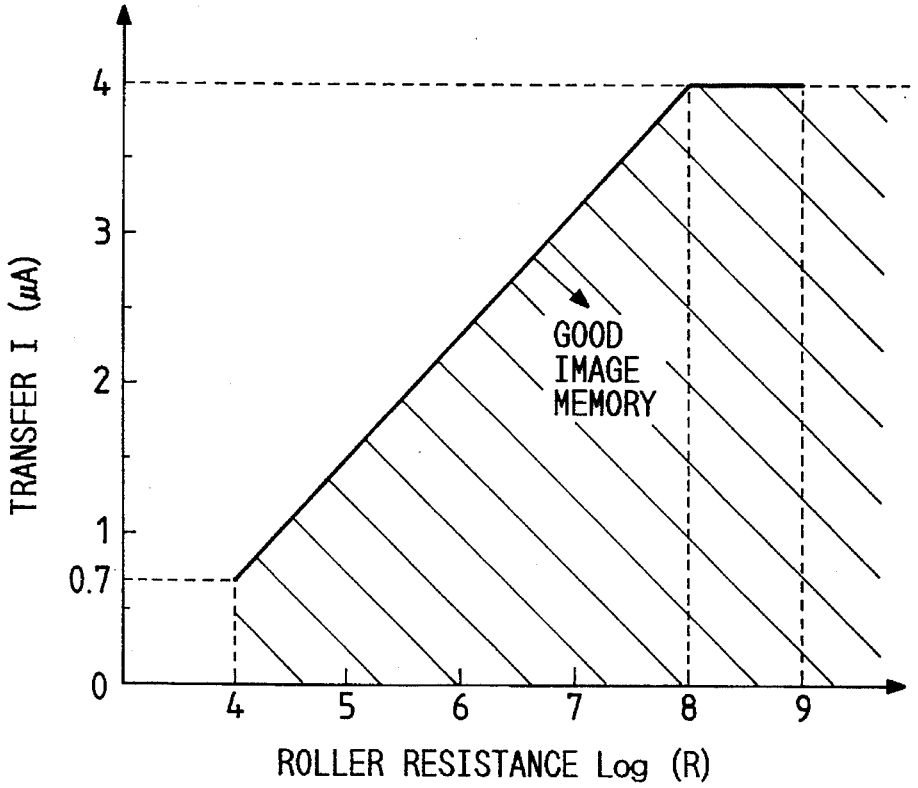
FIG. 23 is a graphical representation of relationship between the transfer roller resistance and the satisfactory areas for a ghost phenomenon.

FIG. 23 shows a relationship between the transfer roller resistance and the transfer current that prevents the occurrence of the ghost phenomenon regardless of the print duty, which are obtained from the results of FIG. 22. If the transfer current used satisfies the following equation with respect to the resistance of the transfer roller used, then the ghost phenomenon preventive condition can be satisfied regardless of the print duty.

$$It \leqq 0.825\{\log(R)-3.15\} \text{ and } It \leqq 4 \qquad \text{(Equation 4)}$$

where It is a transfer current (μA), and log (R) is a logarithmic value (Ω) of the resistance of the transfer roller, and log (R)≦9.

Further, equation 4 varies according to the process speed, the film thickness of the photosensitive layer of the latent image carrier, and the longitudinal length of the contact surface in which the transfer roller and latent image 25 carrier are in contact with each other. More specifically, when Q=C·V, capacitance C is obtained from the equation $C=\epsilon\epsilon_0(n \cdot L/d)$, and charge Q is expressed as $Q=I \cdot t=I(n/V_p)$, where ε is a vacuum permittivity, $\epsilon_0$ is the relative permittivity of the photosensitive layer of the latent image carrier, n is a transfer nip, L is the longitudinal length of a contact surface between the latent image carrier and transfer roller, d is the film thickness of the photosensitive layer of the latent image carrier, t is time, and $V_p$ is a process speed. Therefore, a current I can be expressed as follows:

$$I=\{(\epsilon\epsilon_0(L/d)\,V_p=\{\epsilon\epsilon_0\,LV_p/d\}V$$

where V is the absolute value of the electrification potential of the latent image carrier. If the current I is replaced by the transfer current It, then it can be found that the transfer current It is in inverse proportion to the film thickness d and is in proportion to the length L and speed $V_p$. Therefore, the transfer current It in equation 4 which and satisfies the ghost phenomenon regardless of the print duty can be expressed by the following equation:

$$It \leqq 2.66\times10^{-3}\cdot\{\log(R)-3.15\}\cdot L\cdot V_p/d \text{ and } It \leqq 1.29\times10^{-2}\cdot L\cdot V_p/d \qquad \text{(Equation 5)}$$

where It is the transfer current (μA), log (R) is the logarithmic value (Ω) of the resistance of the transfer roller while log (R)≦9, L the longitudinal length (mm) of the contact surface of the latent image carrier and transfer roller, $V_p$ is the process speed (mm/s), and d is the film thickness (μm) of the photosensitive layer of the latent image carrier.

Next, the image density will be studied.

Figure 24:
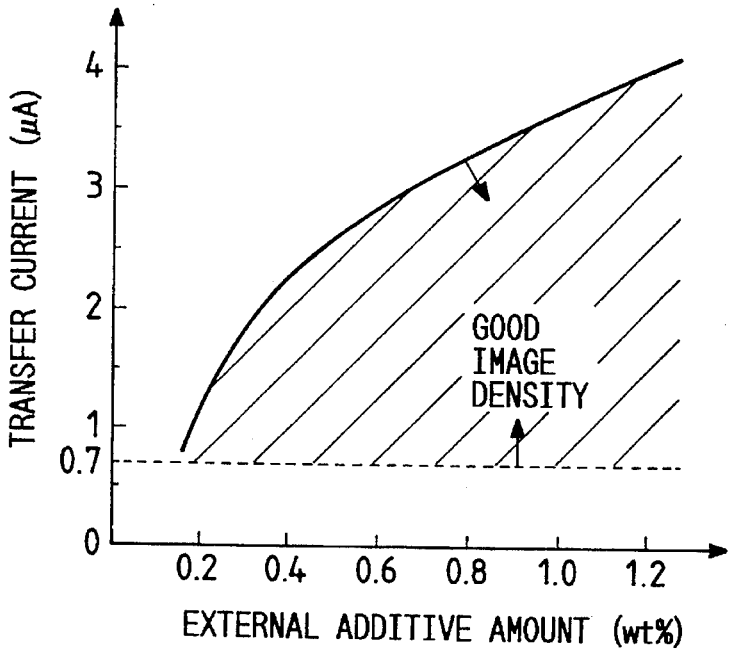
FIG. 24 is a graphical representation of a relationship between the amount of addition of external additives to a toner and the good transfer areas that satisfy the image density.

FIG. 24 shows a relationship between the amount of the external additives of the toner and the good transfer area that satisfies the image density. To satisfy the image density, a transfer efficiency of 90% or more or the amount of adhesion of the toner onto the paper of 0.7 mg/cm$^2$ or more must be satisfied. In the present embodiment, the amount of the toner to be developed by the latent image carrier was 0.8 to 0.9 mg/cm$^2$ and, therefore, the image density can be satisfied only by satisfying the other condition, that is, the transfer efficiency of 90% or more. This is the reason why the transfer efficiency of 90% or more was considered to be the good transfer area.

As shown in FIG. 24, the more the amount of the external additives of the toner is increased, the more the good transfer area that satisfies the image density is expanded. For this reason, as the amount of the external additives of the toner was increased, the need for precision of the supply source was reduced, so that the cost of the supply source could be reduced. Also, the transfer current of the lower limit of the good transfer area (the lowest necessary transfer current that can satisfy the image density) is 0.7 μA regardless of the amount of the external additives of the toner. Therefore, the transfer current must be 0.7 μA or more. Also, when the amount of the external additives of the toner is expressed as ρ (wt %) and the transfer current is expressed as It (unit is μA), to satisfy the image density, it is necessary to satisfy the following equation:

$$0.7 \leqq It \leqq \{14.3(\rho-0.03)\}^{1/2}$$

Further, in the previously described equation, that is, $I=\{\epsilon\epsilon_0\,LV_p/d\}V$, if d is replaced by the thickness of the toner layer, $\epsilon_0$ is replaced by the relative permittivity of the toner, and V is replaced by the voltage that is applied to the toner layer, and also if the toner is taken into consideration, then the transfer current that satisfies the image density (a certain voltage V is applied to the toner layer) depends on and is in proportion to the speed $V_p$ and length L. Therefore, the transfer current that satisfies the image density can be expressed by the following equation:

$$1.32\times10^{-4}\cdot L\cdot V_p \leqq It\{(\rho-0.03)/1.95\}^{1/2}\cdot L\cdot V_p\times10^{-3} \qquad \text{(Equation 6)}$$

where It is the transfer current (μA), ρ is the amount (wt %) of the external additives of the toner, L is the longitudinal length of the contact surface of the latent image carrier and transfer roller, and $V_p$ is the process speed (mm/s).

Note that when a cheaper supply source was chosen in order to minimize the cost, it was necessary to make allowances for ±0.5 μA to take into consideration the temperature characteristic, durability, and variations between the lots of the supply source. Therefore, in that case, it was necessary to secure a range of at least 1 μA as a good transfer area. Since the transfer current of the lower limit of the good transfer area is 0.7 μA regardless of the amount of the external additives of the toner, to secure the above margin, there must exist a good transfer area up to 1.7 μA. From FIG. 24, it can be seen that the amount of the external additives of the toner must be about 0.3 wt % or more in order to satisfy this. Further, when taking the durability of the supply source into consideration, preferably, the amount of the external additives of the toner should be 0.4 wt % or more.

Also, the more the amount of the external additives of the toner was increased, not only the more the good transfer area was expanded, but also the higher the quality of such as fine lines, dots, and gray patterns each consisting of a set of dots. Particularly, a big difference in the image quality was found between 0.4 wt % and 0.6 wt %. Therefore, preferably, the amount of the external additives of the toner should be 0.6 wt % or more. The resistance of the transfer roller was used in the range of $10^4$ to $10^9\Omega$ but the roller resistance had no effect on the good transfer area satisfying the image density.

Figure 25:
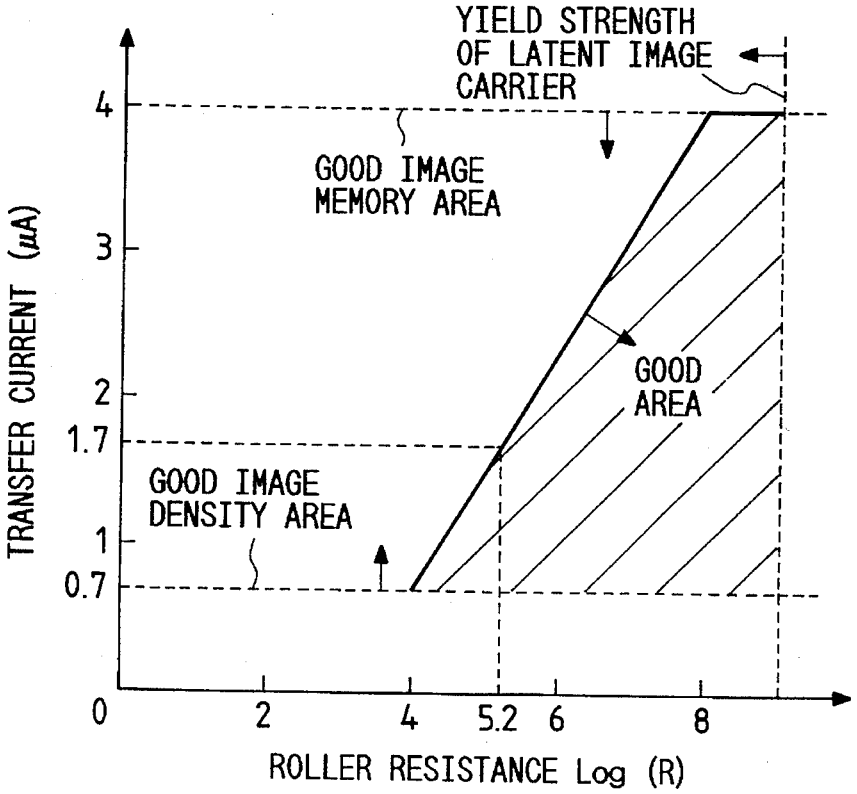
FIG. 25 is a graphical representation of a relationship between the transfer roller resistance and the good transfer areas (the areas that satisfy the image density and prevent the occurrence of a ghost phenomenon).

FIG. 25 shows a relationship between the good transfer area (that satisfies both the image density and ghost phenomenon) and the roller resistance. To satisfy the good transfer area shown in FIG. 25 (that is, an oblique line area in FIG. 25), it is necessary to control the supply source so that the following equation which is based on the equations 5 and 6, is satisfied.

$$1.32\times10^{-4}\cdot L\cdot V_p \leqq It \leqq 2.66\times10^{-3}\{\log(R)-3.15\}\cdot L\cdot V/d, \text{ and } It \leqq 1.29\times10^{-2}\cdot L\cdot V_p/d \qquad \text{(Equation 7)}$$

where It is a transfer current (μA), log(R) is the logarithmic value (Ω) of the resistance of the transfer roller, L is the longitudinal length (mm) of a contact surface between the latent image carrier and transfer roller, $V_p$ is a process speed (mm/s), and d is a film thickness (μm) of the latent image carrier.

Further, it is preferable that, with respect to the transfer current It that satisfies equation 7, the amount of the external additives of the toner is set to satisfy the equation 6.

Also, from FIG. 25, it is found that, if the roller resistance goes below $10^4\Omega$, then no good transfer area exists. Thus, the resistance of the transfer roller must be $10^4\Omega$ or more.

Further, as described before, when trying to minimize the cost of the supply source, the good transfer area must be secured in the range of 0.7 to 1.7 of the transfer current and, therefore, it can be seen from FIG. 25 that the resistance of the transfer roller must be $1.6\times10^5\Omega$ or more ($\log(R) \leqq 5.2$). At the same time, as described before, the amount of the external additives of the toner must be 0.4 wt % or more.

Since the higher the resistance of the transfer roller, the wider the good transfer area, not only the cost of the supply source can be further reduced, but also the freedom in setting the transfer current can be increased. For example, when it is desired to set the transfer current rather high, to obtain a wider good transfer area, or to reduce the cost of the supply source, preferably, the roller resistance should be of the order of $10^7\Omega$ or more, and the amount of the external additives of the toner should be set for a given amount according to the relationship between the image density and good transfer area shown in FIG. 24 (or equation 6).

Figure 26:
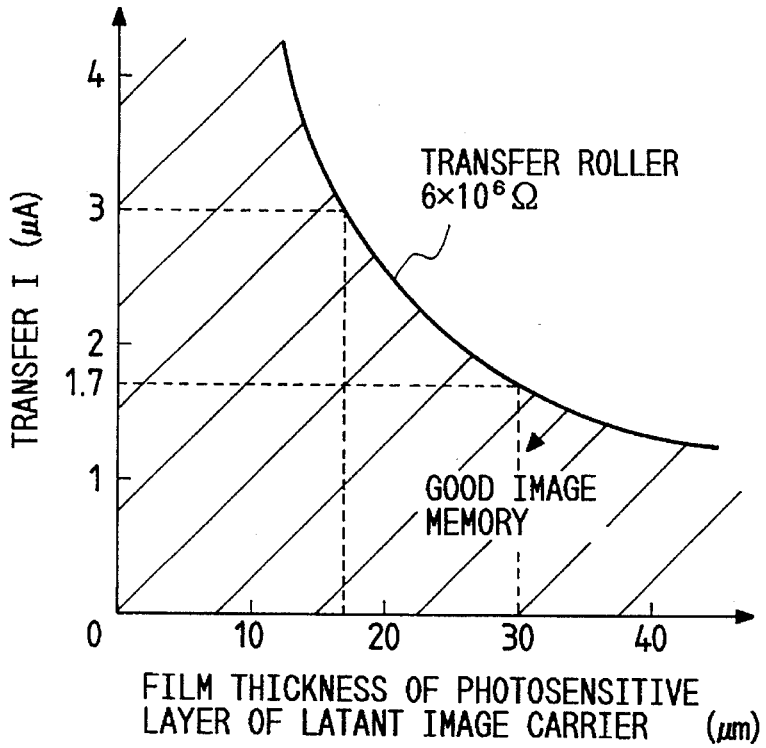
FIG. 26 is a graphical representation of a relationship between the thickness of the photo-sensitive layer of the latent image carrier and the good areas for a ghost phenomenon.

FIG. 26 shows a relationship between a good ghost phenomenon area (an area in which no ghost phenomenon occurs) and the film thickness of the photosensitive layer of a latent image carrier using a transfer roller having a resistance of $6\times10^6\Omega$. In the present embodiment, the film thickness of the photosensitive layer of the latent image carrier was 17 μm. However, when the film thickness of the photosensitive layer of the latent image carrier is increased than this, as can be seen from FIG. 26, the good ghost phenomenon area tends to narrow unfavorably. If the film thickness of the photosensitive layer of the latent image carrier is further increased to exceed approximately 30 μm, then it is not possible to secure the above-mentioned good area which can minimize the cost of the supply source. Therefore, it is preferable for the film thickness of the photosensitive layer of the latent image carrier to be 30 μm or less. On the other hand, if the film thickness of the photosensitive layer of the latent image carrier is decreased, then it is difficult for the ghost phenomenon to occur, as can be seen from FIG. 26. That is, it is preferable for the thickness of the photosensitive layer to be small. However, since the film thickness of the photosensitive layer gets thinner as it is shaved during use, at least 10 μm or more is necessary.

(2-3) Leakage Current and Resistance of Members Other than the Transfer Member

Using the image forming equipment shown in FIG. 17, except that the resistance of the backup roller 22 of the fixing device was changed to $10^6\Omega$, the present inventors conducted an experiment on the ghost phenomenon under the LL and HH environments similar to the above-mentioned embodiment. In this experiment, under the LL environment, almost the same results as in FIG. 21 were obtained. However, under the HH environment, the transfer current, for the most part, flowed along the surface of the recording paper into the backup roller 22 which was grounded. In this case, no ghost phenomenon occurred even at the transfer current of 4 μA but, at the same time, the image density was not satisfied. The reason for this seems that the transfer electric field (that is, a current that flows in the direction of the latent image carrier) was short, resulting in the poor transfer.

Figure 27:
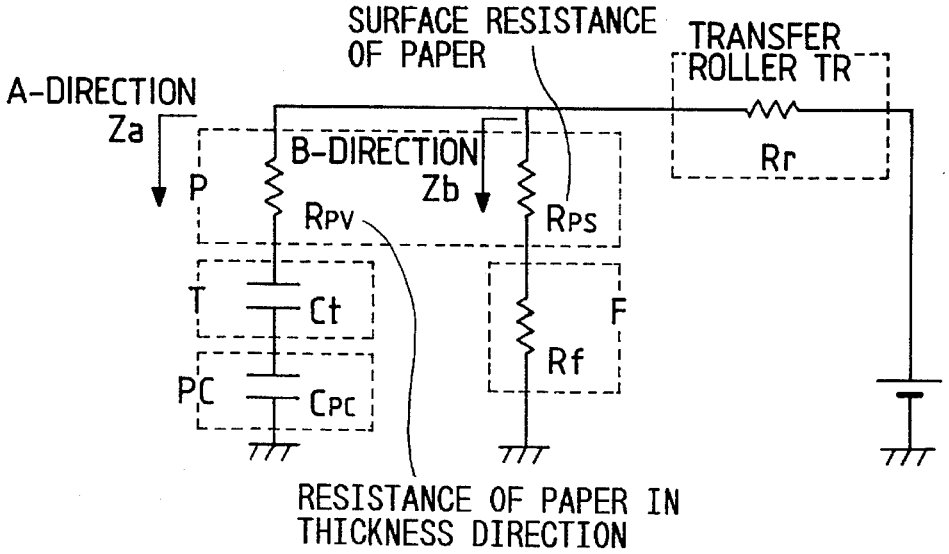
FIG. 27 is a circuit diagram of bias roller transfer which is modeled into an equivalent circuit.

This will be explained below using the transfer model shown in FIG. 27. The impedance Za of a system extending in a direction of an arrow A shown in FIG. 27 is the sum of the resistance of the paper P in the width direction thereof, the capacity Ct of the toner T, and the capacity Cpc of the latent image carrier PC, whereas the impedance Zb of a system extending in a direction of an arrow B in FIG. 27 is the sum of the surface resistance Rps of the paper P and the resistance Rf of the fixing roller F. Referring to the relationship between the impedances Za and Zb, when Za<Zb, then the current flows in the A direction whereas little current flows in the B direction. When Za>Zb, then the current flows in the B direction whereas it little flows in the A direction. The reason why the current is allowed to flow in spite of the existence of the capacitors in FIG. 27 is that a new toner, a new recording member layer and the photosensitive layer of a new latent image carrier are always charged by the rotational movements of the latent image carrier and transfer roller. Therefore, with respect to the unsatisfied result of the image density in the above experiment, it seems that because Za>Zb, most of the current flowed in the B direction in FIG. 27. That is, it seems that, since a given amount of current did not flow in the A direction and thus a given voltage was not applied to the toner T, the poor transfer failed to satisfy the image density.

Also, while the paper (recording member) used in the above experiment was ordinary copying paper (containing a water content of about 9%), another experiment was conducted under an environment similar to the above experiment, using bond paper (containing a water content of about 8%) having a slightly higher resistance than the copying paper. As a result, a good image was obtained with no poor transfer at a transfer current of 1.5 μA. Further, ordinary copying paper and bond paper were respectively cut into a length (about 50 mm) extending between the transfer and fixation of the image forming equipment shown in FIG. 27 and, with electrodes pressed against only one surface of each of the two kinds of paper having the above length, a current of 1 to 4 μA was applied thereto and the surface resistances thereof were measured. The results of the measurements showed that the ordinary copying paper had a resistance of approximately $5\times10^7\Omega$ and the bond paper had a resistance of approximately $6\times10^8\Omega$. In view of this, it can be imagined that, in FIG. 27, the impedance in the A direction was almost equal to the impedance in the B direction. A current of the order of 0.7 μA flowed in the A direction in FIG. 27, which resulted in the good image.

Table 3, shows results obtained when using the image forming equipment shown in FIG. 17. Images were printed while changing the resistance of the back-up roller 22 and the value of the transfer current until good images could be obtained with no leakage current. Also, ordinary copying paper was used as the recording member. As shown in Table 3, if the resistance of the backup roller 22 is $10^9\Omega$ or more, then the images can be transferred with no problem resulting in good images being obtained.

TABLE 3

| | Resistance (Ω) of Backup Roller | | | | | |
|---|---|---|---|---|---|---|
| Transfer current | $10^8$ | $10^7$ | $10^8$ | $5\times10^8$ | $10^9$ | $10^{10}$ |
| 1 μA | X | X | X | Δ | O | O |

TABLE 3-continued

| Transfer current | Resistance (Ω) of Backup Roller | | | | | |
|---|---|---|---|---|---|---|
| | $10^8$ | $10^7$ | $10^8$ | $5 \times 10^8$ | $10^9$ | $10^{10}$ |
| 2 μA | X | X | Δ | ○ | ○ | ○ |
| 3 μA | X | X | Δ | ○ | ○ | ○ |
| 4 μA | Δ | Δ | ○ | ○ | ○ | ○ |

○: No poor transfer due to current leakage and thus, a good image
Δ: Rather poor transfer due to current leakage
X: Poor transfer due to current leakage and thus, a poor image The above-mentioned experiments and transfer model shown in FIG. 27 point out the following facts:

For a sufficient transfer current to flow in the A direction in FIG. 27, it is necessary to control the leakage current. In other words, it is necessary to shut off a passage through which the leakage current flows. The above-mentioned experiments use the backup roller 22 as an example of the leakage current passage. Of course, besides the backup roller 22, there exist many members which can be used as the leakage current passage.

For example, the following can be used as the leakage current passage: the heat roller 21, the pickup roller 10, the ante-transfer guide 108 and its accompanying members, the post-transfer guide 109 and its accompanying members, the paper discharge roller 23 after fixing, a paper separating claw for fixing, an electricity removing brush, an electricity removing roller, a paper feed cassette 11, a gate roller or a carrier roller for prevention of skew or for synchronization with a toner image on a latent image carrier, a detaching roller for detaching a recording member from a latent image carrier, a detect member for detecting the detachment of the recording member from the latent image carrier, a member disposed at a portion where a feed or discharge paper detect sensor comes into contact with a recording member, and the like. That is, when a transfer current is applied to a transfer roller, any of these members can provide a leakage current passage when contacted with a recording member.

And, since the impedance Za in the A direction shown in FIG. 27 varies according to the rotational speed of the latent image carrier (that is, the process speed), the resistance value of the member that can provide a leakage current passage for prevention of the leakage of the transfer current also varies. Then, the condition for the leakage current passage can be obtained by using the above-mentioned equation $I=(\epsilon\epsilon_0 L V_p/d)V$ and the results of Table 4.

Now, since, in the equation, the impedance Z of the latent image carrier and toner is expressed as $Z=(d/\epsilon\epsilon_0 L V_p)$, it is found that the process speed $V_p$ is in inverse proportion to the impedance of the latent image carrier. Since in the present embodiment the process speed $V_p$ is 24 mm/sec., the resistance of the backup roller 22 may be of $10^9\Omega$ or more. Therefore, to prevent the leakage of a current under a high humidity environment, when the resistance of the backup roller 22 is expressed as RB (Ω), then the following equation must be satisfied:

$$RB \geqq 2.4\times10^{10}/V_p\ (\Omega) \qquad \text{(Equation 8)}$$

However, as described before, there are a large number of members which can provide a leakage current passage. That is, if RB in equation 8 is put into a more general expression, then it reads as follows: "The resistance value of a member which is contactable with the paper (a recording member), except for a contact transfer member (transfer roller)". Therefore, when this resistance value is expressed as R' (Ω), then the following equation should be satisfied:

$$R' \geqq 2.4\times10^{10}/V_p\ (\Omega) \qquad \text{(Equation 9)}$$

Of course, even when the member in contact with the paper (recording member) does not satisfy equation 9 during transfer, by setting the member in an electrically floated condition, current leakage can be prevented.

The above-mentioned description can be summed up as follows:

(1) By setting the resistance of the transfer roller in the range of $10^6$ to $10^9\Omega$, occurrence of the ghost phenomenon can be prevented and also transfer is possible by use of a low transfer bias voltage that does not exceed the yield strength of the latent image carrier. This is advantageous in the pin hole control measure, in reduction in the cost of the supply source, and in reduction in the size of the contact transfer device. At the same time, this eliminates the need to provide a high resistance layer or the like on the outer layer of the transfer member and, therefore, is advantageous in the manufacture and cost of the transfer member as well (that is, the need for provision of a multilayer roller is eliminated).

(2) By setting the relationship between the aerated bulk density R of the toner and the hardness H of the transfer member as $R \geqq 0.350+0.001\times H$, white void phenomenon can be reduced.

(3) By using at least two kinds of external additives having different particle diameters with respect to toner particles and setting the total amount of the external additives with respect to the toner particles in the range of 0.5 to 4 wt % (preferably, setting the total amount thereof for 0.7 wt % or more and setting the amount of the external additives that have the greatest average particle diameter in all of the external additives for 0.3 wt % or more), the transfer efficiency can be stabilized and variations in the density can be reduced even through a durability test and an environmental test.

(4) The maximum value of the surface covering ratio of the external additives that can be externally added varies according to the kinds of the surface treating agents for surface treating the external additives to be added to the toner particles. By optimizing the surface covering ratio for every surface treating agent (for example, in the case of silicone oil, setting the surface covering ratio of the external additives with respect to the resin particles for 2.0 or less, and, in the case of hexamethyl disilazan, setting the surface covering ratio of the external additives with respect to the resin particles for 1.6 or less), the amount of fogging on the latent image carrier can be controlled.

(5) By setting the amount W of the external additives and the resistance value R (logarithmic value) of the transfer member so as to satisfy the equation $4 \geqq W \geqq 16.0-3.52\times R+0.2\times R^2$, good contact transfer can be realized by using a simple constant current supply source regardless of the width of the recording member.

(6) By setting the resistance value R of the transfer member, the contact width L of the transfer member with the latent image carrier, the process speed $V_p$, the film thickness d of the photosensitive layer of the latent image carrier, and the transfer current It so as to satisfy the following equation:

$$1.32\times10^{-4}\cdot L\cdot V_p \leqq It \leqq 2.66\times10-3\{\log(R)-3.15\}\cdot L\cdot V_p/d,$$

and $$It \leqq 1.29\times10^{-2}\cdot L\cdot V_p/d, \qquad \text{(Equation 10)}$$

it is possible to prevent the occurrence of a ghost phenomenon even if a transfer member having a relatively low resistance is used.

(7) By setting the relationship between the resistance value R' of a member other than the transfer member to be in contact with the recording member so as to satisfy an equation $R' \geqq 2.4\times10^{10}/V_p$, it is possible to prevent poor transfer due to the leakage of the current.

The above-mentioned seven items can be used individually or can be used in arbitrary combinations thereof. By combining two or more items with one another, it is possible to structure a contact transfer device and image forming equipment which have excellent characteristics.

The materials to be used as the toner compositions in the present invention are not limited to special materials. Ordinary materials can be used. For example, the following can be used as binding resin: polystyrene and its copolymer, polyester and its copolymer, polyethylene and its copolymer, epoxy resin, silicone resin, polypropylene and its copolymer, fluoro-resin, polyamide resin, polyvinyl alcohol resin, polyurethane resin, polyvinyl butyral, and the like. These can be used individually or two or more can be combined together before they are used. As coloring agents, black dyes and pigments such as carbon black, spirit black, Nigrosine and the like can be used. For coloring, dye such as phthalocyanine, Phodamine B lake, solar pure yellow, Qinacridone, polytungustophosphoric acid, indanthrene blue, sulfonamide derivative or the like. As a dispersing agent, metal soap, polyethylene glycol or the like can be used and, as an antistatic agent, electron acceptor organic complex, polyester chloride, nitro-funin acid, quaternary ammonium salt, pyridinyl salt or the like can be added. As a surface lubricant, polypropylene wax, polyethylene wax or the like can be added. Further, as other additives, zinc stearate, zinc oxide, cerium oxide or the like can be used.

Also, various kinds of external additives can be used as the external additives in a transfer device according to the invention. Examples include metal oxides such as silica, alumina, titanium oxide, and the like, inorganic fine particles of composite oxides of these metal, and organic fine particles such as acryl fine particles and the like.

As the surface treating agent for surface treating the external additives used in the transfer device according to the invention, a silane system coupling agent, a titanate system coupling agent, a fluorine containing silane coupling agent, silicone oil and the like can be used. The hydrophobic rate of the external additives surface treated by the above surface treating agent is preferably 40% or more according to a conventional methanol method. If the hydrophobic rate is less than 40%, then friction electrified charges are undesirably decreased due to absorption of water under the high temperature and high humidity environment. Also, with respect to the particle diameter of the external additives, the greatest particle diameter may preferably be 30 nm or more. If the diameter is less than 30 nm, then the external additives are easily embedded, which lowers the transfer efficiency, and which unfavorably results in lowered density. And, among the external additives of several kinds of particle diameters, a ratio of the particle diameter of the external additive having the greatest average particle diameter to the particle diameter of the external additive having the smallest average particle diameter should preferably be 2.0 or more. If it is less than 2.0, then the aerated bulk density of the toner is decreased, so that a toner having an excellent fluidity cannot be obtained, and a white void phenomenon can easily occur.

In the present embodiment, as the transfer member, description has been given of the transfer roller 104. However, instead of the transfer roller 104, it is also possible to use members, a rotatable member such as a belt and the like, and a fixed member such as a blade. In order to be able to deliver the recording member stably and to obtain a high-quality image, use of the rotatable transfer member is preferable.

As the transfer member to be used in the present invention, besides the elastic foam roller described in the illustrated embodiment, of course, a single-layer elastic conductive roller formed of a conductive foam material with a skin, and a multilayer elastic conductive roller including an oozing preventive layer, a resistance control layer, a protective layer and the like can also be used with an equivalent effect. However, due to the fact that the pin hole countermeasure is completed according to the invention, it is preferable that a single-layer transfer roller may be used in view of costs. Also, it is desirable that variations in the resistance of the transfer member with respect to the time for electrically energizing the transfer member and the current (or current density) to be applied are as small as possible. If the variations in the resistance value due to the energizing time are large, then the deteriorated images due to the variation in the transfer efficiency occur undesirably while printing is repeated. On the other hand, if the variations in the resistance value with respect to the current to be applied are large, then the current concentrates locally in the low-resistance portion of the transfer nip where the transfer member and latent image carrier are in direct contact with each other to thereby electrify the latent image carrier to the reversed polarity (in the present embodiment, positive polarity), which unpreferably facilitate the occurrence of a ghost phenomenon when the next image is formed.

Also, the transfer device according to the invention an be used effectively with conventional roller resistance detect means (ATVC control) or the like.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A contact transfer system for forming an image using an electrophotographic process, comprising:

a latent image carrier; and a transfer member, contactable with said latent image carrier, having a bias used to transfer a toner from said latent image carrier to a recording member located between said latent image carrier and said transfer member to thereby form an image;

wherein said contact transfer system satisfies a relationship, $R \geqq 0.350+(0.001*H)$, where R (g/cc) represents an aerated bulk density of said toner and H represents a hardness (JISA) of said transfer member.

2. A contact transfer system as set forth in claim 1, wherein said toner is composed of 0.5 to 4 (wt %) resin particles and has two or more kinds of external additives, respectively having different average particle diameters, added thereto.

3. A contact transfer system as set forth in claim 2, wherein a total amount of said external additives to be added to said toner is at least 0.7 (wt %) with respect to resin particles of said toner, and an amount of one kind of external additive having the largest average particle diameter is at least 0.3 (wt %) with respect to said resin particles of said toner.

4. A contact transfer system as set forth in claim 2 or 3, wherein silicone oil is used for surface treating said external additives of said toner, and a surface covering rate of said external additives with respect to said resin particles is not more than 2.0.

5. A contact transfer system as set forth in claim 2 or 3, wherein hexamethyl disilazan is used for surface treating said external additives of said toner, and a surface covering rate of said external additives with respect to said resin particles is not more than 1.6.

6. A contact transfer system as set forth in claim 1, wherein a resistance value of said transfer member is in a range of $10^6$ to $10^9\Omega$.

7. A contact transfer system as set forth in claim 1, wherein a constant current supply source is used for applying the bias to said transfer member.

8. A contact transfer system as set forth in claim 7, wherein a maximum output voltage of said constant current supply source does not exceed a dielectric strength of said latent image carrier.

9. A constant transfer system as set forth in claim 6 or 7, wherein said transfer member is a rotatable member formed of a single-layer of material.

10. A contact transfer system for forming an image using an electrophotographic process, comprising:

a latent image carrier; and a transfer member, contactable with said latent image carrier, having a bias used to transfer a toner from said latent image carrier to a recording member located between said latent image carrier and said transfer member to thereby form an image;

wherein said contact transfer system satisfies a relationship, $4 \geqq W \geqq 16.0-3.52\times R+0.2\times R^2$, where R represents the logarithmic value of a resistance value of said transfer member, and W (wt %) represents an amount of external additives added to resin particles of said toner.

11. A contact transfer system as set forth in claim 10, wherein the amount of said external additives is defined as $W \geqq 0.7$ (wt %).

12. A contact transfer system as set forth in claim 10, wherein a resistance value of said transfer member is in a range of $10^6$ to $10^9\Omega$.

13. A contact transfer system as set forth in claim 10, wherein a constant current supply source is used for applying the bias to said transfer member.

14. A contact transfer system as set forth in claim 13, wherein a maximum output voltage of said constant current supply surface does not exceed a dielectric strength of said latent image carrier.

15. A contact transfer device as set forth in claim 13 or 14, wherein said transfer member is a rotatable member formed of a single-layer of material.

16. Image forming equipment, comprising:

a latent image carrier having a photosensitive layer; and a transfer member, contactable with said latent image carrier, having a bias used to transfer a toner from said latent image carrier to a recording member located between said latent image carrier and said transfer member to thereby form an image at a given process speed, wherein, when a resistance value of said transfer member is expressed as R (Ω) and a current value of a means for applying said bias is expressed as It (μA), the following relationship is satisfied:

$$1.32\times10^{-4}\cdot L\cdot V_p \leqq It \leqq 2.66\times10^{-3}\{\log(R)-3.15\}\cdot L\cdot V_p/d, \text{ and}$$
$$It \leqq 1.29\times10^{-2}\cdot L\cdot V_p/d,$$

where L represents a longitudinal length (mm) of a contact surface between said transfer member and latent image carrier, $V_p$ represents a process speed (mm/s), and d represents a thickness (μm) of the photosensitive layer of said latent image carrier.

17. Image forming equipment as set forth in claim 16, wherein, when an amount of external additives to be added to said toner is expressed as ρ (wt %), the following relationship is satisfied:

$$It \leqq \{(\rho-0.03)/1.95\}^{1/2}\cdot L\cdot V_p\times10^{-3}.$$

18. Image forming equipment as set forth in claim 16 or 17, wherein a resistance value of said transfer member is in a range of $10^6$ to $10^9$ (Ω).

19. Image forming equipment as set forth in claim 18, wherein a constant current supply source is used for applying the bias to said transfer member.

20. Image forming equipment as set forth in claim 19, wherein a maximum output voltage of said constant current supply source is limited to a dielectric strength of said latent image carrier.

21. Image forming equipment as set forth in claim 18 or 19, wherein said transfer member is a rotatable member formed of a single-layer of material.

22. Image forming equipment as set forth in claim 16 or 20, wherein a film thickness of the photosensitive layer of said latent image carrier is set in a range of 10 to 30 (μm).

* * * * *